US005711143A

United States Patent [19]

Munakata et al.

[11] Patent Number: 5,711,143

[45] Date of Patent: Jan. 27, 1998

[54] OVERHEAD CABLE AND LOW SAG, LOW WIND LOAD CABLE

[75] Inventors: Takeo Munakata; Jun Katoh; Naoshi Kikuchi, all of Tokyo; Naoyoshi Shimokura; Yuji Ishikubo, both of Osaka, all of Japan

[73] Assignees: The Kansai Electric Power Co., Inc., Osaka; The Furukawa Electric Co, Ltd., Tokyo, both of Japan

[21] Appl. No.: 566,409

[22] Filed: Dec. 1, 1995

[30] Foreign Application Priority Data

Apr. 15, 1995 [JP] Japan ..... 7-113687

[51] Int. Cl.[6] ..... D07B 1/06

[52] U.S. Cl. ..... 57/215; 57/219

[58] Field of Search ..... 57/212, 215, 213, 57/219, 230

[56] References Cited

U.S. PATENT DOCUMENTS

| | | | |
|---|---|---|---|
| 1,794,269 | 2/1931 | Zagorski | 57/215 X |
| 2,022,839 | 12/1935 | Austin | 57/215 X |
| 3,240,082 | 3/1966 | Bratz | 57/219 X |
| 3,813,772 | 6/1974 | Adams | 57/215 X |
| 3,823,542 | 7/1974 | Pemberton | 57/215 X |
| 3,979,896 | 9/1976 | Klett et al. | 57/215 X |
| 4,311,001 | 1/1982 | Glushko et al. | 57/215 |
| 5,449,861 | 9/1995 | Fujino et al. | 57/215 X |

*Primary Examiner*—Michael Mansen

*Attorney, Agent, or Firm*—Nikaido Marmelstein Murray & Oram LLP

[57] ABSTRACT

An overhead cable provided with a plurality of segment strands of a sector-shaped cross-section twisted at the outermost layer and having grooves of a substantially arc-shaped cross-section at the surface at the adjoining portions of the segment strands. Also, a low sag, low wind load cable provided with tension-bearing cores comprised of strands having a linear expansion coefficient of $-6\times10^{-6}$ to $6\times10^{-6}$/°C. and an elastic modulus of 100 to 600 PGa and with a plurality of sector-shaped cross-section segment strands twisted around the outermost circumference of the cable including the tension-bearing cores comprised of a super-high-heat resisting aluminum alloy or extra-high heat resisting aluminum alloy, grooves of a substantially arc-shaped cross-section being provided at the surface at adjoining portions of the twisted segment strands. This enables the wind load to be reduced. Further, a low wind load cable can be easily fabricated at a low cost. In addition, by using invar strands for the cores and using segment strands of a super-high heat resisting aluminum alloy or extra-high heat resisting aluminum alloy at the outermost layer, the sag at high temperatures can be greatly suppressed. Accordingly, even the amount of the sideways swinging caused when the overhead cable is struck by a strong wind from the lateral direction can be greatly suppressed together with the low wind load construction.

20 Claims, 13 Drawing Sheets r = 1mm
PITCH 30° r = 2mm
PITCH 30° r = 1.4mm
PITCH 30° r = 2.5mm
PITCH 30° r = 4mm
PITCH 30° r = 1.4mm
PITCH 20°, 30°

24 CONVEXES
RADIUS OF CONVEX = 2.03
RADIUS OF CONCAVE = 3.75

24 CONVEXES
RADIUS OF CONVEX = 2.03
RADIUS OF CONCAVE = 5.8

28 CONVEXES
RADIUS OF CONVEX = 1.85
RADIUS OF CONCAVE = 3.75

28 CONVEXES
RADIUS OF CONVEX = 1.85
RADIUS OF CONCAVE = 5.8

OVERHEAD CABLE AND LOW SAG, LOW WIND LOAD CABLE

BACKGROUND OF THE INVENTION

1. Field of the Invention

The present invention relates to an overhead cable with a low wind load and to a low sag, low wind load cable with a small sag at high temperatures and a small wind load during strong winds.

2. Description of the Related Art

The main type of cables currently being used for overhead lines are cables having steel cores with twisted aluminum strands (for example ACSR). Many improvements have been made in the areas of the materials and mechanical properties to increase the power capability and reduce the sag of these cables. For example, heat resistances have been increased and use has been made of low linear expansion steel strands, for example, invar strands, for the reinforcement cores. Recently, further, there has been much research and development conducted to lower the linear expansion and lighten the weight so as to keep down the elongation of the cables at high temperatures and thereby reduce the sag by replacing the invar strands of the reinforcement cores of aluminum cables with silicon carbide (SiC) fiber-reinforced aluminum composite strands, fiber reinforced plastic strands comprised of carbon fibers or aromatic polyamide fibers impregnated with a plastic, or other strands comprised of inorganic or organic fibers plated with aluminum or zinc.

Cables designed to be reduced in sag in this way are advantageous in that they enable a reduction of the height of the steel towers carrying them since there is less of an increase in sag caused by elongation at high temperatures, but they are increased in wind load during strong winds in the same way as with conventional steel-reinforced aluminum cables. In particular, in extremely high voltage (EHV) multiple conductor transmission lines, the wind load of the lines is a dominant factor in the design of the strength of the steel towers, so there is not enough of an economic merit by just keeping down the sag.

There is known, as shown in FIG. 1, a cable comprised of cores of steel strands 5, aluminum strands 6 twisted around the cores, and sector-shaped cross-section segment strands 15 twisted at the outermost layer around the outer circumference of the same to give a substantially smooth outer circumference. Further, similar to the cable shown in FIG. 1, there is known the transmission line of Japanese Examined Patent Publication (Kokoku) No. 57-46166 wherein the corners of the sector-shaped cross-section segment strands 15 twisted at the outermost layer are formed as arcs so that the tangents of the arcs at the points of intersection between the adjoining abutting surfaces of the segment strands and the corner arcs do not pass through the center of the cable and wherein the radius of curvature of the corner arcs is set to a specific value to reduce the wind load and wind noise.

Further, there is known the low wind load cable of Japanese Examined Patent Publication (Kokoku) No. 5-6765 wherein the height of the projections caused by the spiral strands wound around holding strands of the outermost layer of strands and the center angle of the projections are set to specific values.

Further, there is known a cable as shown in FIG. 2 where tape 16 is wrapped around the outer surface of the aluminum strands 6 to give a wavy surface. These known cables have generally smooth outer surfaces.

As explained above, even cables which have been designed for a reduced wind load by twisting smooth surface sector-shaped cross-section segment strands around the outermost layer receive a wind load when struck by wind. As shown in FIG. 3, when an overhead cable is struck by the wind and the air flows as F along the outer circumference S of the cable, a laminar flow is created along the surface of the cable. Due to the viscosity of air at the plane of contact between the surface of the cable and the air flow, the flow rate of the air at the surface of the cable becomes zero. This results in a distribution of flow rates as illustrated where the flow rate changes as a function of the distance y from the outer circumference S of the cable. That is, a boundary layer B of a small thickness $\delta$ is formed at the outer circumference S of the cable. When a flow is formed along the surface of the cable, the flow rate of the boundary layer B at positions on the downwind side changes as shown by B1→B2→B3. At the boundary layer at the position B3 on the downward side, the kinetic energy is consumed and the flow breaks away from the surface of the cable at the breakaway point P to create a low pressure region at the downwind side of the breakaway point P. Due to this, a pressure difference is created between the upwind side and the downwind side of the breakaway point of the cable. This is the cause of the formation of the wind load on the cable.

To lower the wind load acting on the cable, it may be considered to shift the breakaway point P as far downwind as possible so as to guide the positive pressure of the upwind side of the wind load acting on the cable to the downwind direction. Another method considered to reduce the wind load has been to make the boundary layer which develops turbulent as much upwind as possible and shift the breakaway point P to the downwind side so as to guide the positive pressure of the upwind side downwind. Shifting the breakaway point P as far downwind as possible, however, requires that the flow in the boundary layer not be disturbed.

In the conventional process, the outer circumference was smoothed by twisting smooth surfaced sector-shaped cross-section segment strands around the outermost layer. This was because it was thought that an overhead cable with a generally smooth outer circumference would be resistant to disturbance of the flow in the boundary layer and would have a smaller wind load.

However, when this overhead cable was tested in a wind tunnel, the result was a wind load (drag coefficient) higher than the expected value. The reasons why the drag coefficient did not fall as expected were investigated. As a result, as shown in FIG. 3, it was found to be due to the formation of the step differences in the V-shaped grooves 18 formed at the surface at the adjoining portions 17 of the sector-shaped cross-section segment strands 15, 15 at the outermost layer. The step differences of the V-shaped grooves 18 disturbed the boundary layer. Eliminating the step differences of the V-shaped grooves 18 at the adjoining portions of the twisted segment strands to create a smooth surface, however, necessitates a sophisticated twisting technique and involves the problem of a higher manufacturing cost.

SUMMARY OF THE INVENTION

The present invention has as its first object to provide an overhead cable which solves the above problems, has a small wind load, and is low in cost.

The inventors discovered in the process of development of a low wind load cable that if grooves of a special spiral configuration were provided in the surface of a transmission line, the wind load would fall during strong winds of 30 to 40 m/s or more and thereby completed the present invention.

That is, according to a first aspect of the present invention, there is provided an overhead cable provided with a plurality of segment strands of a sector-shaped cross-section twisted at the outermost layer and having grooves of a substantially arc-shaped cross-section at the surface at the adjoining portions of the segment strands.

Preferably, the ratio L/M of a width L of the substantially arc-shaped cross-section grooves and a width M of the non-groove portions of the surface of the sector-shaped cross-section segment strands is $0.10 \leqq L/M \leqq 1.55$.

Preferably, the ratio H/D of a maximum depth H of the substantially arc-shaped cross-section grooves and a diameter D of the overhead cable is $0.0055 \leqq H/D \leqq 0.082$.

Preferably, there are at least six and not more than 36 sector-shaped cross-section segment strands twisted at the outermost layer.

Preferably, at least one segment strand of the plurality of sector-shaped cross-section segment strands twisted at the outermost layer is comprised of an outer surface projecting segment strand projecting 0.5 to 5 mm from the outer surface of the other segment strands.

Preferably, a deflector angle Θ of 15° to 60° is provided at the shoulders of the outer surface projecting segment strand formed with the projecting step difference.

Preferably, there are at least two of said outer surface projecting segment strands twisted around the outermost layer and the projecting step difference t of the outer surface projecting segment strands and the center angle Θ2 of a group of the outer surface projecting segment strands are $0.5 \leqq t \leqq 2.0$ (mm) and $20° \leqq \Theta 2 \leqq 60°$.

Preferably, the grooves provided at the adjoining portions of the sector-shaped cross-section segment strands at the outermost layer are grooves of a substantially semicircular cross-section and at least one substantially semicircular cross-section groove among the grooves of the outermost layer has a substantially circular cross-section strand fitted in it.

In the present invention, sector-shaped cross-section segment strands are twisted around the outermost layer of the steel strands, aluminum strands, or other strands. The substantially arc-shaped cross-section grooves form spiral grooves in the outer circumference which extend in the longitudinal direction of the overhead cable due to the twisting of the sector-shaped cross-section segment strands at the outermost layer. Note that the overhead cable referred to the present invention means a steel-reinforced aluminum cable (ACSR), aluminum alloy overhead cable, steel overhead cable, overhead ground line, or other overhead cable.

By providing the grooves of a substantially arc-shaped cross-section at the surface of the overhead cable at adjoining portions of the sector-shaped cross-section segment lines twisted at the outermost layer, the surfaces at the adjoining portions of the sector-shaped cross-section segment strands become concave arcs instead of the V-shaped grooves of the past. The boundary layer of the laminar flow flowing over the surface when wind strikes the overhead cable passes through the substantially arc-shaped cross-section grooves with no step differences and moves to the downwind side so as to shift the breakaway point P to the downwind side of the overhead cable. Accordingly, the wind load acting on the overhead cable is reduced.

By providing the surface at the adjoining portions of the sector-shaped cross-section segment strands of the outermost layer with substantially arc-shaped cross-section grooves, the eddies in the substantially arc-shaped cross-section grooves reduce the consumption of the kinetic energy of the boundary layer and cause the breakaway point P to shift to the rear. Further, when the arc of the substantially arc-shaped cross-section grooves approaches a semicircle, the shoulders of the grooves become starting points of turbulence of the boundary layer, turbulence of the boundary layer is caused and the breakaway point is shifted downwind, and, due to the downwind shift of the breakaway point, the drag coefficient is reduced.

If the ratio L/M of the width L of the substantially arc-shaped cross-section grooves provided at the surface at the adjoining portions of the sector-shaped segment strands twisted at the outermost layer and the width M of the non-groove portions of the surface of the sector-shaped cross-section segment strands is less that 0.1, the width of the grooves 3 is too small and the effect of provision of the arc-shaped grooves is insufficient, while if over 1.55, the surface of the overhead cable becomes remarkably rough and there is little effect of reduction of the wind load. A sufficient effect of reduction of the wind load is obtained by making L/M a value of 0.10 to 1.55.

If the ratio H/D of the maximum depth H of the substantially arc-shaped cross-section grooves and the diameter D of the overhead cable is less than 0.0055, there is little effect of reduction of the influence of the eddies in the substantially arc-shaped cross-section grooves, created when the boundary layer passes through the grooves, on the boundary layer at the surface of the overhead cable. Further, if H/D is over 0.082, the surface of the overhead cable becomes remarkably rough and there is little effect of reduction of the wind load. Accordingly, it is preferable to make H/D a value of 0.0055 to 0.082.

If the number of the sector-shaped cross-section segment strands twisted at the outermost layer, that is, the number of the spiral grooves formed in the outer circumference of the overhead cable in the longitudinal direction of the cable by the substantially arc-shaped cross-section grooves, is less than six, there is too wide an interval between the substantially arc-shaped cross-section grooves in the outer circumference of the overhead cable and the effect of reduction of the wind load becomes smaller, while if over 36, the surface of the overhead cable becomes remarkably rough and a sufficient effect of reduction of the wind load is not obtained. Accordingly, the number of the sector-shaped cross-section segment strands twisted at the outermost layer is suitably from six to 36.

By making the outer surface of a sector-shaped cross-section segment strand twisted at the outermost layer project higher from the outer surface of other sector-shaped cross-section segment strands, it is possible to reduce the noise caused when the wind strikes the overhead cable. If the height t of the step difference of the outer surface of the outer surface projecting segment strand projecting from the outer surface of the other segment strands is less than 0.5 mm, there is little effect of reduction of the wind noise, while if over 4 to 5 mm, the corona noise becomes larger. Therefore, a range of 0.5 to 5.0 mm, preferably 0.5 to 2.0 mm, is preferred.

A range of the center angle Θ2 of the outer surface projecting segment strands of 20° to 60° is preferred from the standpoint of prevention of corona noise, though depending on the number of the outer layer segment strands.

By making the height t of the step difference of the outer surface projecting segment strand projecting from the outer surface of the other segment strands much lower than the projecting height of conventional low noise cables, the lift caused when being struck by wind at an angle becomes much lower and low frequency and large amplitude "galloping" vibration becomes difficult to occur.

If the outer surface of a sector-shaped cross-section segment strand is made to project out, when wind strikes the projecting shoulders, an vortex is easily created and the wind load increases, but by providing the two shoulders of the opposite sides of a group of outer surface projecting segment strands with a deflector angle making the gradient of projection of the shoulders a gentle gradient, no vortex will be caused even if wind strikes the shoulders. This deflector angle Θ has little effect if under 15° or over 60°, so a range of 15° to 60° is suitable. Further, by providing the outer surface projecting segment strands with a deflector angle at the two shoulders and providing the surface at the adjoining portions 8 with substantially arc-shaped cross-section grooves, the corona noise caused during light rain in a high electric field can be reduced.

By forming the substantially arc-shaped cross-section grooves provided at the surface at the adjoining portions of the segment strands at the outermost layer as semicircular cross-section grooves, that is, making the arc a semicircle, and fitting in at least one substantially semicircular cross-section groove among the grooves of the outermost layer a substantially circular cross-section strand and twisting it, the semicircular cross-section groove positively makes the boundary layer passing through it turbulent to move the breakaway point downwind and thereby reduce the wind load acting on the overhead cable. The circular cross-section strand fit in the semicircular cross-section groove reduces the noise caused by the wind. The semicircular shape of the semicircular cross-section groove is suitable for engagement with the circular cross-section strand.

Note that this low wind load cable unavoidably increases in sag due to the elongation of the cable at high temperatures even though the wind load is reduced. For example, with a span of 1000 to 3000 meters, the sag becomes several dozen meters or more. There are limits on the maximum sag when ships etc. have to cross under the cables. Accordingly, even with cables designed to be reduced in wind load, an increase in the sag at times of high temperatures is disadvantageous to the design of the steel towers since depending on the conditions under the lines, it is necessary to use high strength cables and lay them to have remarkably high tensions at all times. Further, if laying them with high tension, the low wind load cable easily suffers from vibration due to the wind since the surface is substantially smooth. This increases the concern over fatigue of the lines due to the vibration and makes it necessary to install bulky dampers or spend large amounts on daily maintenance and inspection.

Demand for power is expected to grow in the future. Many of the routes will not only run across hilly areas, but will also pass through urban areas. Therefore, development of techniques for making compact, high density transmission systems is desired. Therefore, it is desired to (1) reduce the increase in the wind load received by cables even under hurricane or other high speed winds and (2) suppress the increase in sag even at high temperatures where the temperature of the cable is caused to rise. Compact, economical designs of steel towers are desired. However, conventional ACSR or sag-suppressing cables or low wind load cables have only the single function of reducing the sag or the single function of reducing the wind load. None has had both the functions of a low sag and low wind load.

Therefore, the present invention has as its second object the provision of a low sag, low wind load cable which enables the increase in the sag caused by the elongation of the cable at high temperatures to be suppressed, enables the increase in the wind load of the cable to be reduced even at high wind speeds, and is low in cost.

To achieve the second object, according to a second aspect of the present invention, there is provided a low sag, low wind load cable provided with tension-bearing cores comprised of low linear expansion coefficient and high elastic modules strands of a linear expansion coefficient of $-6\times10^{-6}$ to $6\times10^{-6}$/°C. and an elastic modules of 100 to 600 PGa and a plurality of sector-shaped cross-section segment strands twisted at the outermost circumference of the cable including the tension-bearing cores and comprised of a super-high heat resisting aluminum alloy or extra-high heat resisting aluminum alloy and having grooves of a substantially arc-shaped cross-section provided in the surface at adjoining portions of the segment strands.

Preferably, the tension-bearing cores are comprised of invar strands or composite strands consisting of filaments of silicon carbide fiber, carbon fiber, alumina fiber, or other inorganic fiber or aromatic polyamide fiber or other organic fiber plated or coated on the surface with a metal selected from the group of aluminum, zinc, chrome, and copper.

Preferably, the ratio L/M of the width L of the substantially arc-shaped cross-section grooves and the width M of the non-groove portions of the surface of the sector-shaped cross-section segment strands is 0.10 to 1.55.

Preferably, the ratio H/D of a maximum depth H of the substantially arc-shaped cross-section grooves and the diameter D of the cable is 0.0055 to 0.082.

Preferably, at least one segment strand of the plurality of sector-shaped cross-section segment strands twisted at the outermost layer is comprised of an outer surface projecting segment strand projecting 0.5 to 5 mm from the outer surface of other segment strands.

Preferably, the step difference t of the outer surface projecting segment strand is 0.5 to 5.0 mm.

Preferably, the step difference t of the outer surface projecting segment strand is 0.5 to 2.0 mm.

Preferably, a deflector angle Θ is 15° to 60° is provided at the shoulders of the outer surface projecting segment strands formed with the step differences.

Preferably, the grooves provided at the adjoining portions of the sector-shaped cross-section segment strands at the outermost layer are grooves of a substantially semicircular cross-section, at least one substantially semicircular cross-section groove among the grooves of the outermost layer has a substantially circular cross-section strand fitted in it, and a step difference is formed so that the outermost surface of the circular cross-section strand is made to project out higher from the outer surface of the sector-shaped cross-section segment strands.

Preferably, the number N of the sector-shaped cross-section segment strands twisted at the outermost layer is 6 to 36.

Preferably, there are at least two of the outer surface projecting segment strands twisted at the outermost layer and the step difference t of the outer surface projecting segment strands and the center angle Θ2 of the group of the outer surface projecting segment strands are $0.5 \leqq t \leqq 2.0$ (mm) and $20° \leqq \Theta 2 \leqq 60°$.

Note that in the present invention, the "cable" of the low sag, low wind load cable includes not only transmission lines, but also overhead ground lines.

Since the low sag, low wind load cable according to the second aspect of the present invention uses tension-bearing cores comprised of low linear expansion coefficient and high elastic modulus strands of a linear expansion coefficient of $-6\times10^{-6}$ to $6\times10^{-6}$/°C. and an lelastic modulus of 100 to 600

GPa and uses sector-shaped cross-section segment strands at the outermost layer comprised of a super-high heat resisting aluminum alloy or extra-high heat resisting aluminum alloy, the increase in the sag caused by elongation of the cable at high temperatures can be suppressed. Further, by providing grooves of a substantially arc-shaped cross-section at the surface at adjoining portions of the sector-shaped cross-section segment strands twisted at the outermost layer, it is possible to reduce the increase in wind load on the cable even during hurricane and other high speed winds.

By using tension-bearing cores comprised of invar strands or composite strands consisting of filaments of silicon carbide fiber, carbon fiber, alumina fiber, or other inorganic fiber or aromatic polyamide fiber or other organic fiber plated or coated on the surface with a metal selected from the group of aluminum, zinc, chrome, and copper, it is possible to reduce the elongation of the tension members of ⅓ to ¼ of the elongation of the steel cores of an ACSR and thereby greatly suppress the sag even during the highest temperatures in the summer.

If use is made of super-high heat resisting aluminum alloy strands for the layer of aluminum strands twisted between the layer of the sector-shaped cross-section segment strands twisted at the outermost layer and the center tension bearing cores, the the current capacity is increased about twice. Note that in a cable using invar strands with small linear expansion coefficients for the tension bearing cores, the stress component of the aluminum portion becomes zero at the normally approximately 90° C. transition point. At temperatures higher than that, the tension is calculated using the linear expansion coefficient $\alpha s$ and the elastic modulus Es of just the invar strands.

The cable provided with substantially arc-shaped cross-section grooves at the surface at the adjoining portions of the sector-shaped cross-section segment strands twisted at the outermost layer is formed with spiral grooves in its longitudinal direction. When wind strikes a cable having such substantially arc-shaped cross-section grooves, the boundary layer of the laminar flow flowing over the surface passes through the substantially arc-shaped cross-section grooves with no step differences to move downwind, the breakaway point is shifted downwind down the cable, and the wind load is thereby reduced. This action is the same as with the overhead cable of the first aspect of the invention, so will not be discussed further.

BRIEF DESCRIPTION OF THE DRAWINGS

The present invention may be more fully understood from the description of the preferred embodiment of the invention set forth below, together with the accompanying drawings, wherein.

DESCRIPTION OF THE PREFERRED EMBODIMENTS

Below, preferred embodiments of the present invention will be explained with reference to the drawings.

First Embodiment

Figure 4:
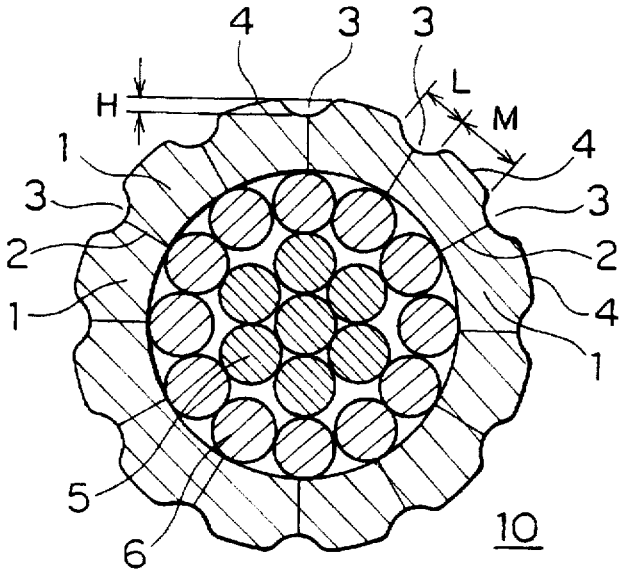
FIG. 4 is a view of a first embodiment of the present invention.

FIG. 4 shows a first embodiment of the present invention. In this embodiment, aluminum strands 6 are twisted around cores 5 made of steel strands. At the outermost layer on the outer circumference of the same are twisted a plurality of sector-shaped cross-section segment strands 1. These segment strands 1 are constituted by conductors made of aluminum alloy, copper, etc. or are constituted by strands with conductors on their surfaces (for example, aluminum-covered steel strands). Examples of overhead cables 10 with these twisted on their outermost layers are steel-reinforced aluminum cables (ACSR), aluminum alloy overhead cables, copper overhead cables, overhead ground lines, and other overhead cables.

At the surface of the overhead cable at the adjoining portions 2 of the sector-shaped cross-section segment strands twisted at the outermost layer are provided grooves 3 with cross-sections of circular, elliptical, or other concave arcs. These substantially arc-shaped cross-section grooves 3 form spiral grooves in the outer circumference off the overhead cable 10 in the longitudinal direction of the cable due to the twisting of the strands 1.

The number of the sector-shaped cross-section segment strands 1 twisted at the outermost layer, that is, the number of the spiral grooves formed in the outer circumference of the overhead cable in the longitudinal direction of the cable by the substantially arc-shaped cross-section grooves 3, is preferably 6 to 36. The embodiment shown in FIG. 4 is an example of 12 segment strands 1. If the width of the concave arc-shaped cross-section grooves 3 is L and the width of the non-groove portions of the surfaces of the arc-shaped cross-section segment strands 1 is M, L/M is preferably in the range of 0.10 to 1.55. Further, if the maximum depth of the substantially arc-shaped cross-section grooves 3 is H and the diameter of the overhead cable is D, then H/D is preferably in the range of 0.0055 to 0.082.

When the overhead cable 10 is struck by the wind, the boundary layer of the laminar flow flowing over the surface passes through the substantially arc-shaped cross-section grooves 3 to move downwind and the breakaway point shifts downwind down the overhead cable. Accordingly, the wind load acting on the overhead cable is reduced.

Figure 8:
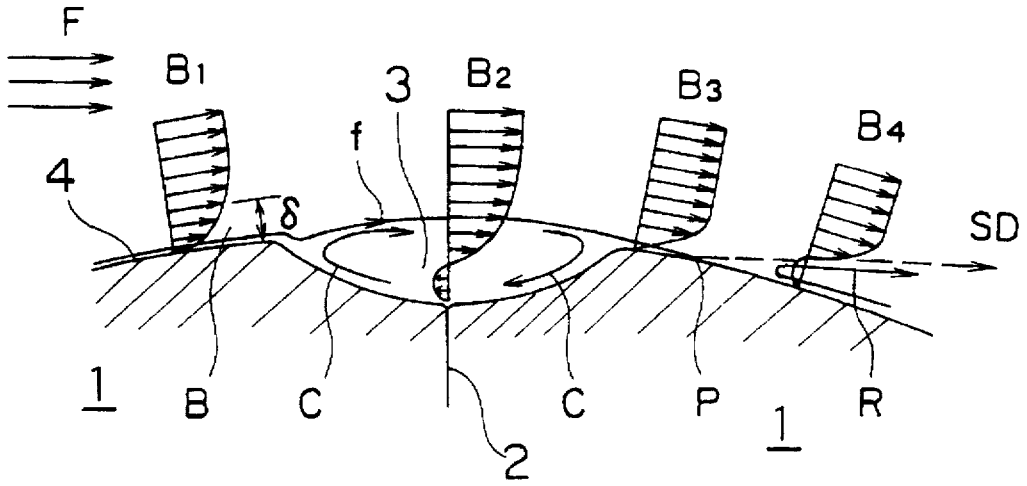
FIG. 8 is a view explaining the state of a boundary layer at substantially arc-shaped cross-section grooves in a stream of wind.

When the substantially arc-shaped cross-section grooves 3 are arc-shaped curves of gentle gradients such as elliptical curves, the boundary layer passing through the substantially arc-shaped cross-section grooves 3 passes through the grooves without being disturbed and the breakaway point P shifts downwind. As shown in FIG. 8, when the overhead cable is struck by the wind and the air flow F flows along the outer circumference 4 of the sector-shaped cross-section segment strands 1 on the outermost layer forming the surface of the overhead cable, a boundary layer B of a small thickness δ is formed on the outer circumference 4. The flow rate of the boundary layer B at positions on the outer circumference 4 changes as shown by B1→B2→B3→B4. When the boundary layer passes through substantially arc-shaped cross-section grooves 3 of a gentle gradient, the result is as shown by B2, that is, vortex C is created in the arc-shaped grooves 3, the consumption of the kinetic energy of the boundary layer B passing through the arc-shaped grooves 3 is reduced, and the breakaway of the boundary layer from the surface of the overhead cable caused by the consumption of the kinetic energy is delayed by the amount of the reduction of the consumption of the energy so that the breakaway point P flows downwind to shift down the overhead cable.

The area downwind of the breakaway point P becomes a low pressure region where a reverse flow R is formed. The boundary with this region becomes the discontinuous surface SD. By enabling the boundary layer passing through the substantially arc-shaped cross-section grooves 3 to move downwind without being disturbed and enabling the breakaway point P to shift downwind, the high air pressure at the upwind side of the overhead cable acts on the down side of the overhead cable and therefore the wind load acting on the overhead cable is reduced. Since the adjoining corners of the sector-shaped cross-section segment strands 1 at the surface of the adjoining portions 2 are positioned at the bottom of the substantially arc-shaped cross-section grooves 3, even if there is a step difference at the surface of the adjoining portions 2, the effect is limited to the flow in the substantially arc-shaped cross-section grooves 3 and therefore the effect of the vortex C in the grooves 3 on the boundary layer of the surface of the overhead cable is reduced.

Figure 9:
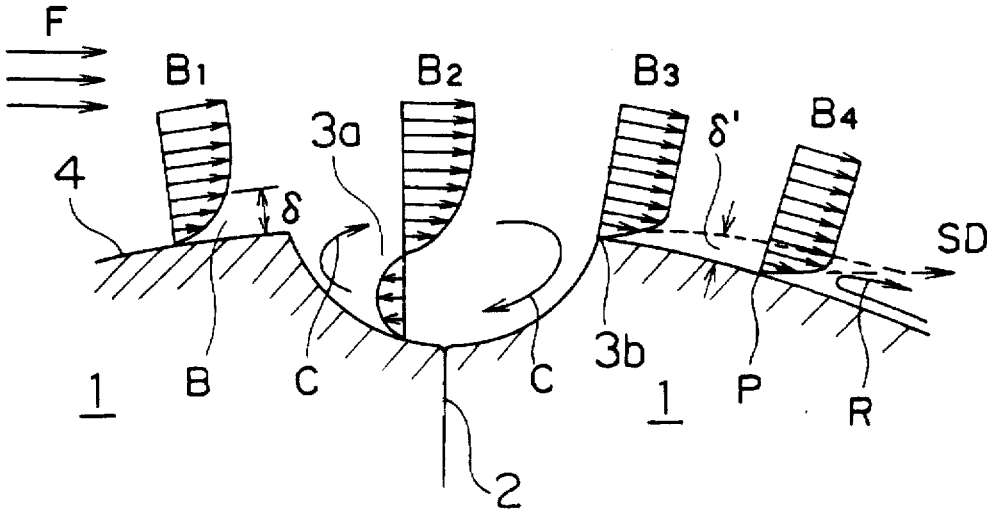
FIG. 9 is a view explaining the state of a boundary layer at substantially semicircular cross-section grooves in a stream of wind.

When the arc of the substantially arc-shaped cross-section grooves 3 provided at the surface at the adjoining portions 2 of the sector-shaped cross-section segment strands at the outermost layer is a semicircle, the boundary layer passing through the semicircular cross-section grooves is positively made turbulent and the breakaway point shifts downwind. If the arc of the substantially arc-shaped cross-section grooves 3 approaches a semicircle, as shown in FIG. 9, the boundary layer B of a small thickness δ flowing on the outer circumference 4 of the sector-shaped cross-section segment strands of the outermost layer serving as the surface of the overhead cable changes in flow rate at the different positions on the outer circumference 4 as shown by B1→B2→B3→B4. A vortex C is created in the semicircular grooves **3*a* and when it passes over the downwind side grooves 3*b* of the semicircular cross-section groove 3*a* as shown by B2, the shoulder 3*b* serves as a base point for the turbulence and turbulence is caused at the boundary layer of the thickness δ'. Therefore, a strong mixed turbulence is caused in the boundary layer, the breakaway point P shifts downstream, and a reverse flow R occurs downstream of the discontinuous surface SD resulting in a low pressure region. Accordingly, the high air pressure of the upwind side of the overhead cable is led to the downwind side of the overhead cable and the wind load acting on the overhead cable is reduced. Also, since the substantially arc-shaped cross-section grooves 3** form spiral grooves in the outer circumference of the overhead cable in the longitudinal directions of the cable due to the twisting of the sector-shaped cross-section segment strands of the outermost layer, an air flow is created along the spiral grooves, there is active mixing of the flow at the wake flow side, the wake flow region down the overhead cable is reduced, and as a result of this as well, the wind load is reduced.

As mentioned earlier, by providing substantially arc-shaped cross-section grooves 3 at the surface at the adjoining portions 2 of the sector-shaped cross-section segment strands 1 of the outermost layer, the vortex in the substantially arc-shaped cross-section grooves 3 reduces the consumption of the kinetic energy of the boundary layer and causes the breakaway point to shift to the rear. Further, when the arc shape of the substantially arc-shaped cross-section grooves 3 approaches a semicircle, the shoulders of the grooves become the base points of turbulence of the boundary layer, turbulence of the boundary layer is caused and the breakaway point is shifted downwind, and, due to the downwind shift of the breakaway point, the drag coefficient is reduced.

If the ratio L/M of the width L of the substantially arc-shaped cross-section grooves 3 provided at the surface at the adjoining portions 2 of the sector-shaped segment strands 1 twisted at the outermost layer and the width M of the non-groove portions of the surface of the sector-shaped cross-section segment strands 1 is less than 0.1, the width of the grooves 3 is too small and the effect of provision of the arc-shaped grooves 3 is insufficient, while if over 1.55, the surface of the overhead cable becomes remarkably rough and there is little effect of reduction of the wind load. A sufficient wind load reducing effect is obtained by making L/M a value of 0.10 to 1.55.

If the ratio H/D of the maximum depth H of the substantially arc-shaped cross-section grooves 3 and the diameter D of the overhead cable is less than 0.0055, there is little effect of reduction of the influence of the vortex "C" in the substantially arc-shaped cross-section grooves 3, created when the boundary layer passes through the grooves, on the boundary layer at the surface of the overhead cable. Further, if H/D is over 0.082, the surface of the overhead cable becomes remarkably rough and there is little effect of reduction of the wind load. Accordingly, it is preferable to make H/D a value of 0.0055 to 0.082.

If the number of the sector-shaped cross-section segment strands 1 twisted at the outermost layer, that is, the number of the spiral grooves formed in the outer circumference of the overhead cable in the longitudinal direction of the cable by the substantially arc-shaped cross-section grooves 3, is less than six, there is too wide an interval between the substantially arc-shaped cross-section grooves at the outer circumference of the overhead cable and the effect of reduction of the wind load becomes smaller, while if over 36, the surface of the overhead cable becomes remarkably rough and a sufficient effect of reduction of the wind load is not obtained. Accordingly, the number of the sector-shaped cross-section segment strands twisted at the outermost layer is suitably from 6 to 36.

Second Embodiment

Figure 5:
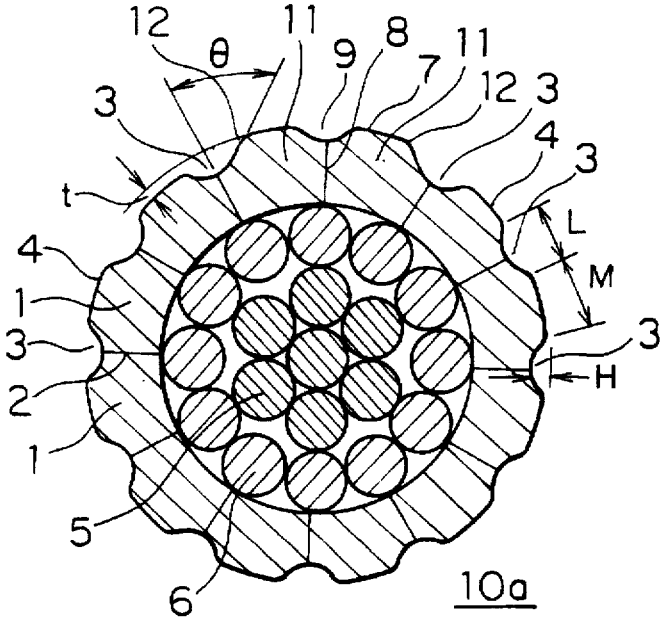
FIG. 5 is a view of a second embodiment of the present invention.

FIG. 5 shows an overhead cable 10*a* of a second embodiment of the present invention. This second embodiment is similar to the first embodiment in that aluminum strands 6 are twisted around cores 5 made of steel strands, then sector-shaped cross-section segment strands 1 are twisted around the outer circumference at the outermost layer, but at least two sector-shaped cross-section segment strands 11, 11 among the sector-shaped cross-section segment strands of the outermost layer are made to project out at their outer surfaces 7 from the outer surfaces 4 of the other segment strands 1. The height t forming the step difference projecting out from the outer surface 4 of the other segment strands 1 is in a range of 0.5 to 5 mm, preferably 0.5 to 2.0 mm. By making the outer surfaces 7 of the sector-shaped cross-section segment strands 11 twisted at the outermost layer project out higher from the outer surfaces 4 of the other sector-shaped cross-section segment strands 1 (see FIG. 5), it is possible to reduce the noise caused when the wind strikes the overhead cable. The reasons why the height t by which the outer surface 7 of the outer surface projecting segment strands 11 projecting from the outer surfaces 4 of the other segment strands 1 is made the above range will be explained in the later embodiments.

By making the height t of the step difference of the outer surface projecting segment strand projecting from the outer surface of the other segment strands much lower than the projecting height of conventional low noise cables, the lift force caused when being struck by wind at an angle becomes much lower and low frequency, large amplitude "galloping" vibration becomes difficult to occur.

If the outer surface of the sector-shaped cross-section segment strand is made to project out, when wind strikes the projecting shoulder, a vortex is easily created and the wind load increases, but by providing the two shoulders 12, 12 on the opposite sides of the group of outer surface projecting segment strands 11, 11 with a deflector angle making the gradient of projection of the shoulders a gentle gradient, no vortex will be caused even if wind strikes the shoulders. This deflector angle Θ has little effect if under 15° or over 60°, so a range of 15° to 60° is suitable. Further, by providing the outer surface projecting segment strands 11, 11 with a deflector angle at the two shoulders and providing the substantially arc-shaped cross-section groove 9 at the surface at the adjoining portions 8, the corona noise caused during light rain in a high electric field can be reduced.

In the second embodiment as well, the surfaces of the overhead cable at the adjoining portions 2 of the sector-shaped cross-section segment strands 1 are provided with substantially arc-shaped cross-section grooves 3 in the same way as the first embodiment, and the surfaces of the adjoining portions 8 of the outer surface projecting segment strands 11, 11 are provided with the substantially arc-shaped cross-section groove 9.

The maximum depth H of the grooves 3 and the groove 9 is the same as in the embodiment shown in FIG. 4. The ratio L/M of the width L of the grooves 3 and the groove 9 and the width M of the non-groove portions of the surfaces of the sector-shaped cross-section segment strands 1 and 11 is the same as in the embodiment shown in FIG. 4 as well.

Third Embodiment

Figure 6:
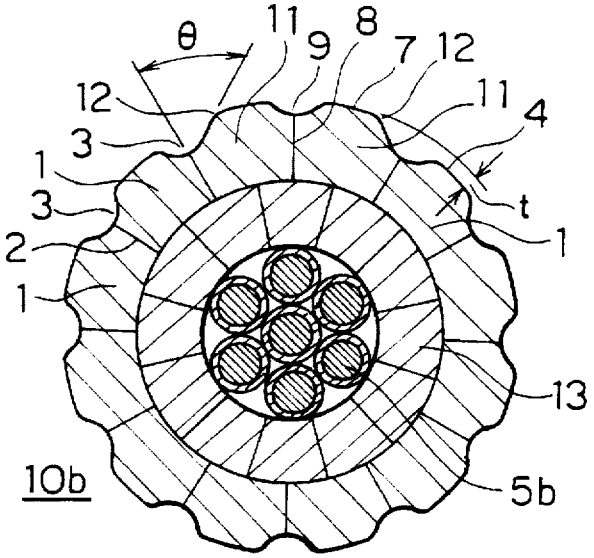
FIG. 6 is a view of a third embodiment of the present invention.

FIG. 6 shows an overhead cable 10*b* of a third embodiment of the present invention. Reference numerals the same as those used in the embodiment shown in FIG. 5 indicate the same portions. The third embodiment is a modification of the second embodiment shown in FIG. 5. It is an example in which the steel cores 5 in FIG. 5 are made copper-coated steel strands 5*b* and in which sector-shaped cross-section segment strands 13 are twisted around them instead of the aluminum strands 6. The embodiment is the same as the second embodiment shown in FIG. 5 in the points that the outer surfaces of at least two sector-shaped cross-section segment strands 11, 11 among the sector-shaped cross-section segment strands of the outermost layer are made to project out higher than the outer surfaces of the other segment strands 1 by a height t, a deflector angle Θ is provided at the two shoulders 12, 12 at opposing sides of the group of outer surface projecting segment strands 11, 11, and a substantially arc-shaped cross-section groove 9 is provided at the surface at the adjoining portions 8 of the outer surface projecting segment strands 11, 11.

The second embodiment and the third embodiment are reduced in the noise caused by wind due to the outer surface projecting segment strands 11 projecting out from the outer circumference of the overhead cable 10. In the second and the third embodiments, the ratio n/N of the number N of sector-shaped cross-section segment strands 1 twisted at the outermost layer and the number n of the outer surface projecting segment strands 11 is preferably made a range of 0.025 to 0.5.

Fourth Embodiment

Figure 7:
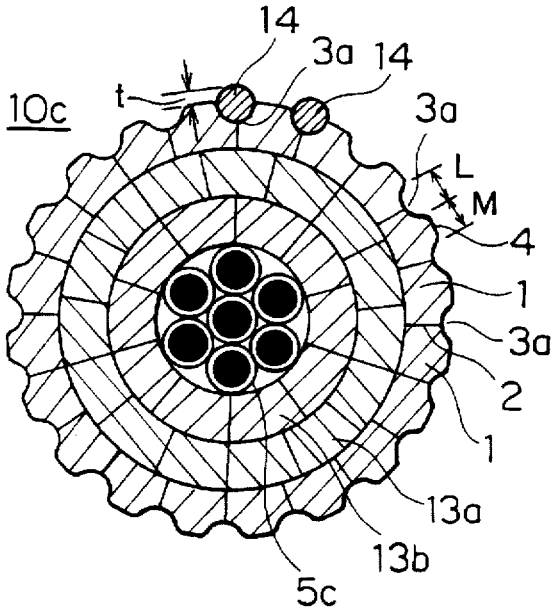
FIG. 7 is a view of a fourth embodiment of the present invention.

FIG. 7 shows an overhead cable 10*b* of a fourth embodiment of the present invention. Reference numerals the same as those used in the embodiment shown in FIG. 4 indicate the same portions. The fourth embodiment is the same as the third embodiment in the point that the steel cores 5*c* are made copper-coated steel strands and sector-shaped cross-section segment strands are twisted around them instead of the aluminum strands 6, but the example is shown of two layers of the sector-shaped segment strands 13*a* and 13*b*. In the fourth embodiment, the substantially arc-shaped cross-section grooves provided at the surface of the overhead cable at the adjoining portions 2 of the sector-shaped cross-section segment strands 1 at the outermost layer are made semicircular cross-section grooves 3*a* and a circular cross-section strand 14 is fit in at least one semicircular cross-section groove 3*a* among the semicircular cross-section grooves 3*a* at the outermost layer. The reference t shown in FIG. 7 if the height by which the outermost surface of the circular strand 14 projects out from the outer surface of the sector-shaped cross-section segment strand 1. In the same way as in the second embodiment, the height t is preferably in a range of 0.5 to 5 mm. The letter L shows the width of the semicircular cross-section groove 3*a* and the letter M shows the width of the non-groove portion of the surface of the sector-shaped cross-section segment strand 1. The ratio L/M is the same as in the first embodiment.

In the fourth embodiment, when the boundary layer passes through the semicircular cross-section grooves 3*a* and passes over the shoulder on the downwind side, the shoulder acts as a base point for the turbulence of the boundary layer, the boundary layer is positively made turbulent, and the breakaway point shifts downwind, resulting in a reduction in the wind load acting on the overhead cable. Further, the circular cross-section strand 1 projecting higher than the outer surface of the sector-shaped cross-section segment strand 1 reduces the noise caused by the wind. The semicircular shape of the semicircular cross-section groove 3*a* is suited for engagement with the circular cross-section strand 14.

Fifth Embodiment

Figure 17:
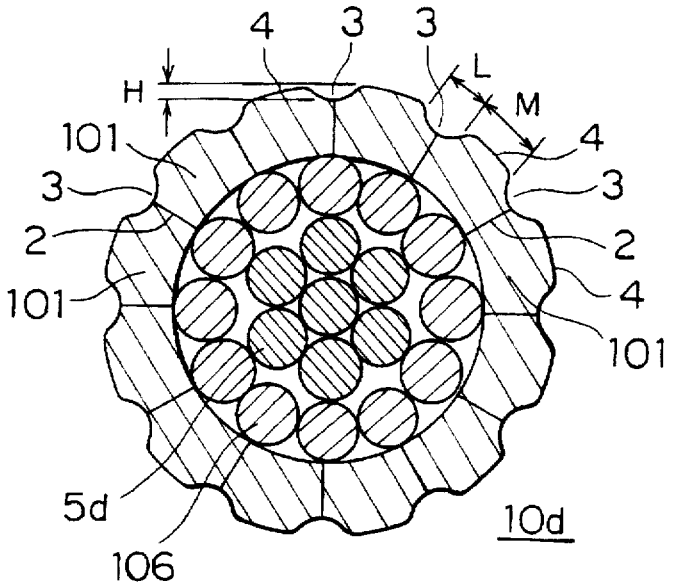
FIG. 17 is a lateral cross-section view of a low sag, low wind load cable according to a fifth embodiment of the present invention.

FIG. 17 shows a low sag, low wind load cable of a fifth embodiment of the present invention. This uses tension bearing cores 5*d* at the center of the cable 10*d* comprised of low linear expansion coefficient, high elastic modulus invar strands, that is, strands with a linear expansion coefficient of −6 to $6\times10^{-6}$/°C. and an elastic modulus of 100 to 600 GPa. Around the tension bearing cores 5*d* are twisted super-high heat resisting aluminum alloy strands 106. At the outermost layer on the outer circumference of the same are twisted a plurality of sector-shaped cross-section segment strands 101 comprised of a super-high heat resisting aluminum alloy. This low wind load, invar-reinforced super-high heat resisting aluminum alloy cable is referred to below as a "LP-ZTACIR". In place of the super-high heat resisting aluminum alloy mentioned above, use may also be made of a so-called extra-high heat resisting aluminum alloy to make a low wind load, invar-reinforced extra-high heat resisting aluminum alloy cable referred to below as a "LP-XTACIR".

The components of the LP-ZTACIR and LP-XTACIR low sag, low wind load cables of the present invention are shown in Table 1.

The mechanical properties and allowable temperatures of the LP-ZTACIR and LP-XTACIR are shown in Table 2 in comparison with the properties of a conventional steel-reinforced aluminum cable.

TABLE 1

| Component | Abbreviation | Description | Japanese Industrial Standard No. |
|---|---|---|---|
| Super-high heat resisting aluminum alloy strands | ZTA1 | Electric grade aluminum with small amount of zirconium etc. added | JIS H2110 |
| Extra-high heat resistant aluminum alloy strands | XTA1 | Same as above | Same as above |
| Zinc plated invar strands | — | High strength invar strands plated with zinc | — |
| Aluminum covered invar strands | — | High strength invar strands uniformly covered with aluminum meeting standards of electric grade aluminum | — |

TABLE 2

| | | | Properties of core strands | | | Property of Al alloy strands | | | Allowable temperature (°C.) | | |
|---|---|---|---|---|---|---|---|---|---|---|---|
| | Type of cores | Type of Al alloy | Min. tensile strength (kgf/mm²) | Elastic modulus (kgf/mm²) | Linear expansion coefficient ($10^{-6}$/°C.) | Min. tensile strength (kgf/mm²) | Elastic modulus (kgf/mm²) | Linear expansion coefficient ($10^{-6}$/°C.) | Continuous | Short time | Instantaneous |
| LP-ZTACIR | Zinc plated invar strands | ZTAI | 150–110 | 16,500 | 2.8*1 | 16.2–17.9 | 6,800 | 23.0 | 210 | 240 | 280 |
| LP-XTACIR | Invar strands | XTAI | 95–105 | 15,500 | 3.7*2 | 16.2–17.9 | 6,800 | 23.0 | 230 | 290 | 360 |
| Reference ACSR | Zinc plated steel strands | HAI | 125–135 | 21,000 | 11.5 | 16.2–17.9 | 6,800 | 23.0 | 90 | 120 | 180 |

Notes:
*1When over transition point $\alpha = 3.6 \times 10^6$ (/°C.)
*2When over 230° C., $\alpha = 10.8 \times 10^6$ (/°C.)

Further, as the low linear expansion coefficient, high elastic modulus strands for making the tension bearing cores 5d, that is, the strands having a linear expansion coefficient of $-6$ to $6\times10^{-6}$/°C. and an elastic modulus of 100 to 600 GPa, it is also possible to use composite strands consisting of filaments of silicon carbide fiber, carbon fiber, alumina fiber, or other inorganic fiber plated or coated on the surface with a metal selected from the group of aluminum, zinc, chrome, and copper.

Further, as the low linear expansion coefficient, high elastic modulus strands for making the tension bearing cores 5d, it is also possible to use composite strands consisting of an aromatic polyamide fiber or other heat resistant organic fiber plated or covered with a metal or to use a fiber reinforced plastic filament comprised of an aromatic polyamide fiber or other heat resistant organic fiber impregnated with a plastic and solidified or a composite strand comprised of this fiber reinforced plastic filament covered with aluminum or another metal to improve its weather resistance.

The low sag, low wind load cable 10d of the fifth embodiment of the present invention shown in FIG. 17 provides at the surface at the cable at adjoining portions 2 of the sector-shaped cross-section segment strands 101, comprised of the super-high heat resisting aluminum alloy or extra-high heat resisting aluminum alloy, twisted at the outermost layer, grooves 3 of a circular, elliptical, or other concave arc-shaped cross-section.

The number of the sector-shaped cross-section segment strands 101 twisted at the outermost layer, that is, the number of the spiral grooves formed in the outer circumference of the cable in the longitudinal direction of the cable by the substantially arc-shaped cross-section grooves 3, is preferably 6 to 36. The embodiment shown in FIG. 7 is an example of 12 segment strands 101. If the width of the concave arc-shaped cross-section grooves 3 is L and the width of the non-groove portions of the surfaces of the arc-shaped cross-section segment strands 1 is M, L/M is preferably in the range of 0.10 to 1.55. Further, if the maximum depth of the substantially arc-shaped cross-section grooves 3 is H and the diameter of the cable is D, then H/D is preferably in the range of 0.0055 to 0.082.

Since the cable according to this embodiment of the present invention uses tension-bearing cores 5 at the center of the strands comprised of the strands of a linear expansion coefficient of $-6\times10^{-6}$ to $6\times10^{-6}$/°C. and an elastic modulus of 100 to 600 PGa and uses sector-shaped cross-section segment strands 101 at the outermost layer comprised of a super-high-heat resisting aluminum alloy or extra-high heat resisting aluminum alloy, the increase in the sag caused by elongation of the cable at high temperatures can be suppressed. Further, by providing the grooves 3 of a substantially arc-shaped cross-section at the surface at adjoining portions 2 of the sector-shaped cross-section segment strands 101 twisted at the outermost layer, the increase in wind load borne by the cable is reduced even during hurricane and other high speed winds.

By using tension-bearing cores comprised of invar strands or composite strands consisting of filaments of silicon carbide fiber, carbon fiber, alumina fiber, or other inorganic fiber or aromatic polyamide fiber or other organic fiber plated or coated on the surface with a metal selected from the group of aluminum, zinc, chrome, and copper, the elongation of the tension members is reduced to ⅓ to ¼ of the elongation of the steel cores of ACSR and thereby the sag is greatly suppressed even during the highest temperatures in the summer.

Since use is made of super-high heat resisting aluminum alloy strands for the layer 106 of aluminum strands twisted between the layer of the sector-shaped cross-section segment strands 101 twisted at the outermost layer and the center tension bearing cores 4, the current capacity is increased about twice. Note that in a cable using invar strands with small linear expansion coefficients for the tension bearing cores, the stress component of the aluminum portion becomes zero at the normally approximately 90° C. transition point. At temperatures higher than that, the tension can be calculated using the linear expansion coefficient $\alpha s$ and the elastic modulus Es of just the invar strands.

The cable provided with the substantially arc-shaped cross-section grooves 3 at the surface at the adjoining portions 2 of the sector-shaped cross-section segment strands 101 twisted at the outermost layer is formed with spiral grooves in its longitudinal direction. When wind strikes an overhead cable having such substantially arc-shaped cross-section grooves 3, the boundary layer of the laminar flow flowing over the surface passes through the substantially arc-shaped cross-section grooves 3 with no step differences to move downwind, the breakaway point P is shifted downwind down the cable, and the wind load is reduced. This action is the same as with the overhead cable of the first to fourth embodiments of the invention, so will not be discussed further.

Sixth Embodiment

Figure 18:
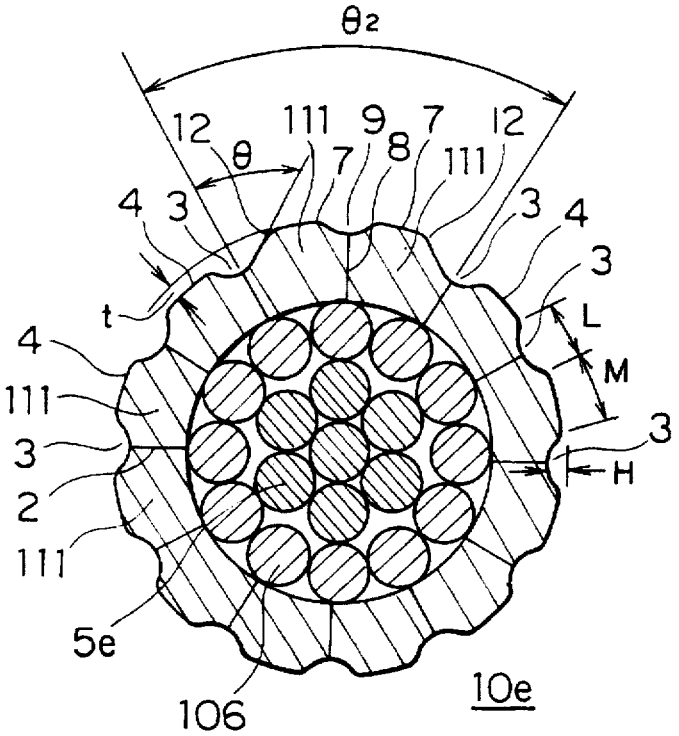
FIG. 18 is a lateral cross-sectional view of a low sag, low wind load cable according to a seventh embodiment of the present invention.

FIG. 18 shows a low sag, low wind load cable 10e according to a sixth embodiment of the present invention. The sixth embodiment is the same as the fifth embodiment shown in FIG. 17 in that super-high heat resisting aluminum alloy strands 106 are twisted around invar strands 5e serving as the center tension bearing cores and sector-shaped cross-section segment strands 101 comprised of a super-high heat resisting aluminum alloy or extra-high heat resisting aluminum alloy are twisted on the outer circumference at the outermost layer. In this embodiment, at least two sector-shaped cross-section segment strands 111, 111 among these sector-shaped cross-section segment strands of the outermost layer are made to project out at their outer surfaces 7 from the outer surfaces 4 of the other segment strands 101. The height t of the segment strands 111 formed with the step differences projecting from the outer surfaces 4 of these other segment strands 101 is 0.5 to 5 mm, preferably 0.5 to 2 mm.

The shoulders 12, 12 of the opposite sides of the two adjacently arranged outer surface projecting segment strands 111, 111 are provided with a deflector angle Θ for making the projecting gradient of the shoulders a gentle gradient so as to prevent the occurrence of the vortex liable to occur at the shoulders. The defector angle Θ is preferably in the range of 15° to 60°. FIG. 18 shows the angle Θ for only the left shoulder 12 of the left segment strand 111 of the two outer surface projecting segment strands 111, 111, but the same angle Θ may also be formed at the right shoulder 12 of the right segment strand 111.

The angle Θ2 shown in FIG. 18 indicates the center angle formed between the two sides of the two adjacent outer surface projecting segment strands 111, 111. The center angle Θ2 is preferably in the range of 20° to 60° from the standpoint of prevention of corona noise, though depending on the number of the outer layer segment strands.

In the sixth embodiment shown in FIG. 18 as well, in the same way as the fifth embodiment, substantially arc-shaped cross-section grooves 3 are provided at the surface of the cable at the adjoining portions 2 of the sector-shaped cross-section segment strands 101 and a substantially arc-shaped cross-section groove 9 is provided at the surface at the adjoining portions 8 of the outer surface projecting segment strands 111, 111. The maximum depth H of the grooves 3 and the groove 9 is the same as in the embodiment shown in FIG. 17. The ratio L/M of the width L of the grooves 3 and the groove 9 and the width M of the non-groove portions of the surfaces of the sector-shaped cross-section segment strands 101 and 111 is the same as in the embodiment shown in FIG. 17 as well.

Seventh Embodiment

Figure 19:
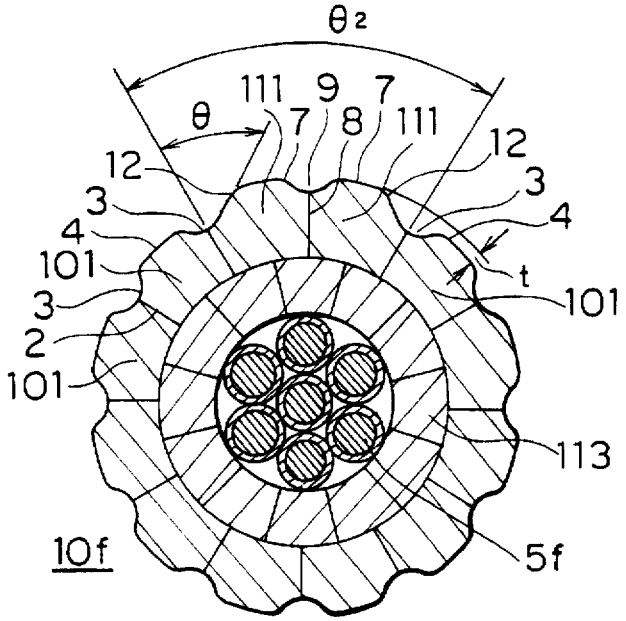
FIG. 19 is a lateral cross-sectional view of a low sag, low wind load cable according to a seventh embodiment of the present invention.

FIG. 19 shows a low sag, low wind load cable **10*f* according to a seventh embodiment of the present invention. Members common with the members shown in FIG. 18** are indicated by common reference numerals and explanations of the same are omitted.

The seventh embodiment is a modification of the sixth embodiment shown in FIG. 18 wherein the invar strands used as the cores **5*e* in FIG. 18 are made aluminum-covered steel strands and sector-shaped cross-section segment strands 113 comprised of super-high heat resisting aluminum alloy or extra-high heat resisting aluminum alloy are twisted around them instead of the super-high heat resisting aluminum alloy strands 106. The cable of the seventh embodiment shown in FIG. 19 is the same as the sixth embodiment shown in FIG. 18 in the points that the outer surfaces of at least two sector-shaped cross-section segment strands 111, 111 among the sector-shaped cross-section segment strands of the outermost layer are made to project out from the outer surfaces of the other segment strands 101 by a height t to form a step difference of 0.5 to 5 mm, preferably 0.5 to 2 mm, providing the two shoulders 12, 12 on the opposite sides of the two outer surface projecting segment strands 111, 111 with a deflector angle Θ, providing a substantially arc-shaped cross-section groove 9 at the surface at the adjoining portions 8 of the outer surface projecting segment strands 111, 111, and making the center angle Θ2 between the two sides of the outer surface projecting segment strands 111, 111** a range of 0° to 60°.

In the sixth and seventh embodiments, the outer surface projecting segment strands 111 projecting out from the outer circumference of the cables **10*e* and 10*f* reduce the noise caused by the wind. In the sixth and seventh embodiments, the ratio n/N of the number N of sector-shaped cross-section segment strands 101 twisted at the outermost layer and the number n of the outer surface projecting segment strands 111** is preferably made a range of 0.025 to 0.5.

Eighth Embodiment

Figure 20:
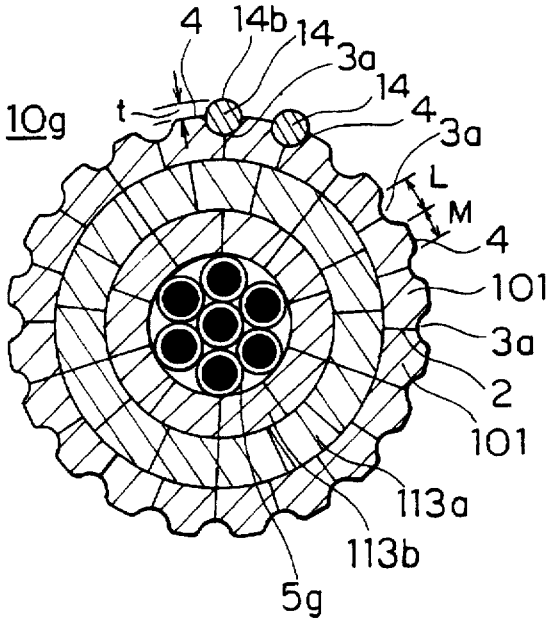
FIG. 20 is a lateral cross-sectional view of a low sag, low wind load cable according to an eight embodiment of the present invention.

FIG. 20 shows a low sag, low wind load cable **10*f* according to an eighth embodiment of the present invention. Members common with the members shown in FIG. 17** are indicated by common reference numerals and explanations of the same are omitted.

The eighth embodiment is similar to the third embodiment in that the invar strands of the cores **5*g* are zinc plated and sector-shaped cross-section segment strands comprised of a super-high heat resisting aluminum alloy or extra-high heat resisting aluminum alloy are twisted around them instead of the super-high heat resisting aluminum alloy strands 106. In this embodiment, the example is shown of two layers of the sector-shaped segment strands 113*a* and 113*b*. In the eighth embodiment, the substantially arc-shaped cross-section grooves 3 provided at the surface of the overhead cable at the adjoining portions 2 of the sector-shaped cross-section segment strands 101 at the outermost layer are made semicircular cross-section grooves 3*a* and a circular cross-section strand 14 is fit in at least one semicircular cross-section groove 3*a* among the semicircular cross-section grooves 3*a* at the outermost layer. The reference t is the height by which the outermost surface 14*b* of the circular strand 14 fit in the semicircular cross-section groove 3*a* projects out from the outer surface 4 of the sector-shaped cross-section segment strands 101. In the same way as in the sixth embodiment, the projecting height t is preferably in a range of 1.5 to 5 mm. The letter L shows the width of the semicircular cross-section grooves 3*a* and the letter M shows the width of the non-groove portions of the surfaces of the sector-shaped cross-section segment strands 101. The ratio L/M is the same as in the fifth embodiment. In the eighth embodiment, when the boundary layer passes through the semicircular cross-section groove 3*a* and passes over the shoulder on the downwind side, the shoulder acts as a base point for the turbulence of the boundary layer, the boundary layer is positively made turbulent, and the breakaway point shifts downwind, resulting in a reduction in the wind load acting on the cable. Further, the circular cross-section strand 14 projecting higher than the outer surface of the sector-shaped cross-section segment strands 101** reduces the noise caused by the wind.

Below, the present invention will be explained in more detail with reference to specific examples which, however, do not restrict the invention in any way.

Note that in the examples and comparative examples shown below, the Reynold's number Re was found from the formula $Re=\rho UD/\mu$ (where, ρ is the density of air, U is the flow rate of air, D is the diameter of the cable, and μ is the viscosity coefficient). The drag coefficient Cd is found from the formula $Cd=2d/(\rho U^2A)$ (where, d is the drag received by the cable and A is the projected area of the cable on the upwind side).

EXAMPLES 1 TO 6 AND COMPARATIVE EXAMPLE 1

Wind tunnel tests were conducted on overhead cables according to the first embodiment of the invention shown in FIG. 4 and on cables according to the fifth embodiment shown in FIG. 17. Steel-reinforced aluminum cables of a diameter d of 36.6 mm were prepared, the number N of sector-shaped cross-section segment strands 1 on the outermost layer changed, and the drag coefficients measured in the range of a Reynold's number of $1.2\times10^4$ to $9.9\times10^4$.

For comparison, wind tunnel tests were conducted on a conventional ordinary steel-reinforced aluminum cable (Comparative Example 1) formed by twisting circular cross-section aluminum strands around steel cores.

Figure 10:
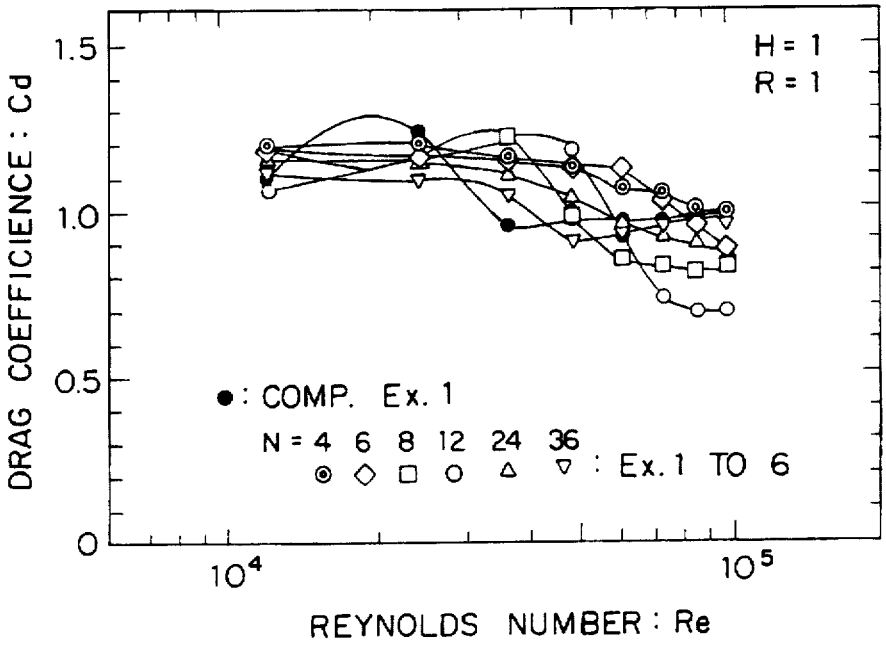
FIG. 10 is a view of the relationship between a drag coefficient and Reynold's number when setting a specific depth of the substantially arc-shaped cross-section grooves and changing the number of the grooves.

FIG. 10 shows the relationship between the drag coefficient Cd and the Reynold's number Re in the case of setting the depth H of the substantially arc-shaped cross-section grooves 3 to 1.0 mm (H/D=0.027) and the radius H of the arc-shaped grooves 3 (radius of the arc of the arc-shaped grooves 3) to 1.0 mm and changing the number of the arc-shaped grooves 3, that is, the number N of the sector-shaped cross-section segment strands 1 twisted at the outermost layer (Examples 1 to 6).

From FIG. 10, it is learned that under conditions of a Reynold's number Re of over $5\times10^4$ (wind speed of about 20 m/s), where the effect of the wind load on the overhead cable becomes a problem, the overhead cables of Examples 1 to 6 have areas of smaller drag coefficients Cd than the conventional cable (Comparative Example 1). In particular, the reduction of the drag coefficient Cd is remarkable with a number N of grooves of from 6 to 36.

EXAMPLES 7 TO 10

Figure 11:
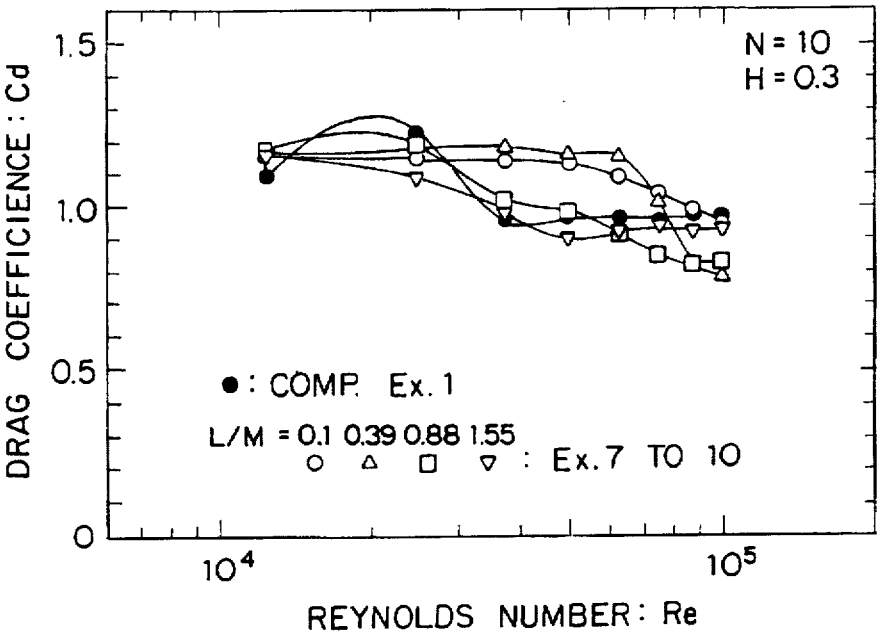
FIG. 11 is a view of the relationship between the drag coefficient and Reynold's number when setting a specific number of grooves and depth of the grooves and changing the ratio of L/M of the width L of the grooves and the width M of the non-groove portions.

Wind tunnel tests were conducted on overhead cables according to the first embodiment of the invention shown in FIG. 4 and cables according to the fifth embodiment shown in FIG. 17. Steel-reinforced aluminum cables of a diameter D of 36.6 mm were prepared, the number N of substantially arc-shaped cross-section grooves 3 (number of sector-shaped cross-section segment strands 1 on the outermost layer) was set to 10 and the depth H of the grooves 3 to 0.3 mm (H/D=0.0082), and the ratio L/M of the width L of the concave arc-shaped cross-section grooves 3 and the width M of the non-groove portions of the surfaces of the sector-shaped cross-section segment strands 1 were changed (Examples 7 to 10). FIG. 11 shows the relationship between the drag coefficient Cd and the Reynold's number Re in this case. The drag coefficient was measured in the range of a Reynold's number of $1.2\times10^4$ to $9.9\times10^4$.

From FIG. 11, it is learned that under conditions of a Reynold's number Re of over $5\times10^4$, the overhead cables of Examples 7 to 10 have areas of smaller drag coefficients Cd than Comparative Example 1 in the range of the ratio L/M of 0.10 to 1.55.

EXAMPLES 11 TO 16

Figure 12:
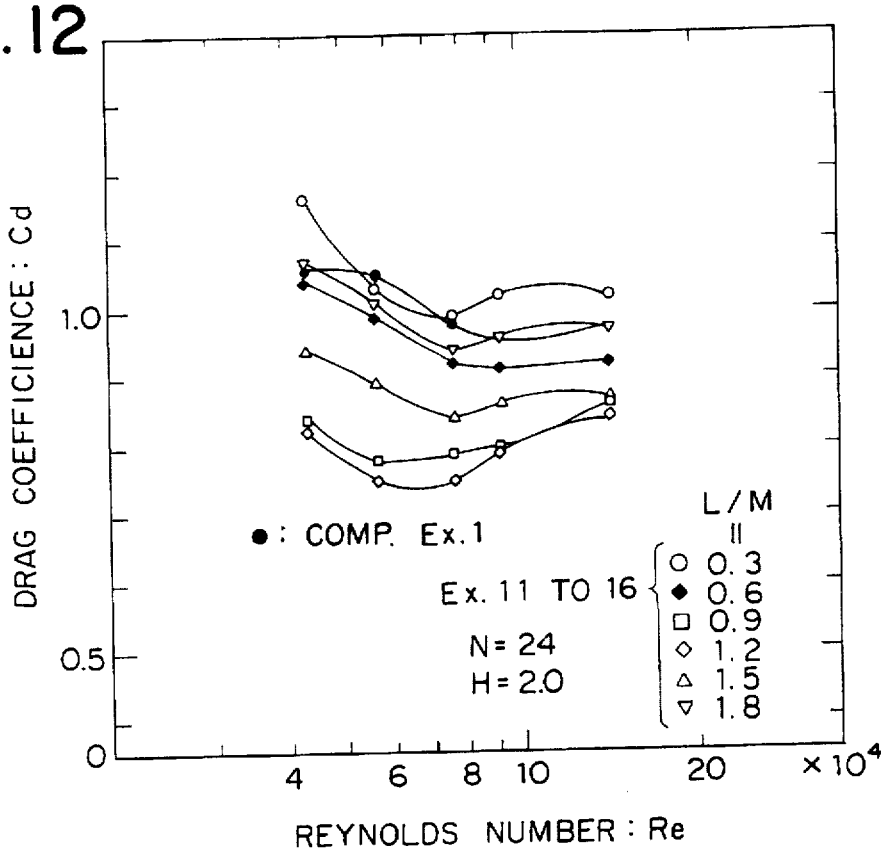
FIG. 12 is a view of the relationship between the drag coefficient and Reynold's number when changing the settings of the number of grooves and depth of the grooves and changing the ratio L/M.

Wind tunnel tests were conducted on overhead cables according to the first embodiment of the invention shown in FIG. 4 and cables according to the fifth embodiment shown in FIG. 17. Steel-reinforced aluminum cables of a diameter D of 36.6 mm were prepared, the number N of substantially arc-shaped cross-section grooves 3 of the sector-shaped cross-section segment strands 1 on the outermost layer was set to 24 and the depth H of the grooves 3 to 0.2 mm, and the ratio L/M was changed (Examples 11 to 16). FIG. 12 shows the relationship between the drag coefficient Cd and the Reynold's number Re in this case.

From FIG. 12, it is learned that under conditions of a Reynold's number Re of over $5\times10^4$, the overhead cables of Examples 11 to 16 have areas of smaller drag coefficients Cd than the conventional cable of Comparative Example 1. In particular, the drag coefficient Cd is small over the entire region when L/M is from 0.6 to 1.5.

EXAMPLES 17 TO 22

Figure 13:
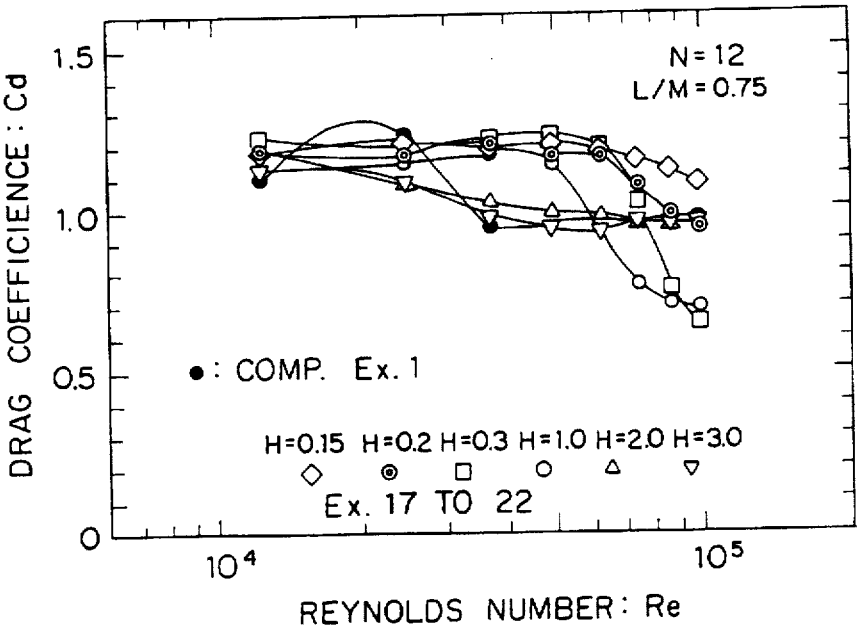
FIG. 13 is a view of the relationship between the drag coefficient and Reynold's number when setting a specific ratio L/M and the number of grooves and changing the depth of the grooves.

Wind tunnel tests were conducted on overhead cables according to the first embodiment of the invention shown in FIG. 4 and cables according to the fifth embodiment shown in FIG. 17. Steel-reinforced aluminum cables of a diameter D of 36.6 mm were prepared, the L/M of the sector-shaped cross-section segment strands 1 of the outermost layer was set to 0.75 and the number N of grooves to 12, and the depth H of the grooves 3 is changed from 0.15 to 3.0 mm (H/D=0.0041 to 0.082) (Examples 17 to 22). FIG. 13 shows the relationship between the drag coefficient Cd and the Reynold's number Re in this case.

From FIG. 13, it is learned that under conditions of a Reynold's number Re of over $5\times10^4$, the overhead cables of Examples 17 to 22 have areas of smaller drag coefficients Cd than the conventional cable.

EXAMPLES 23 TO 28*

Figure 14:
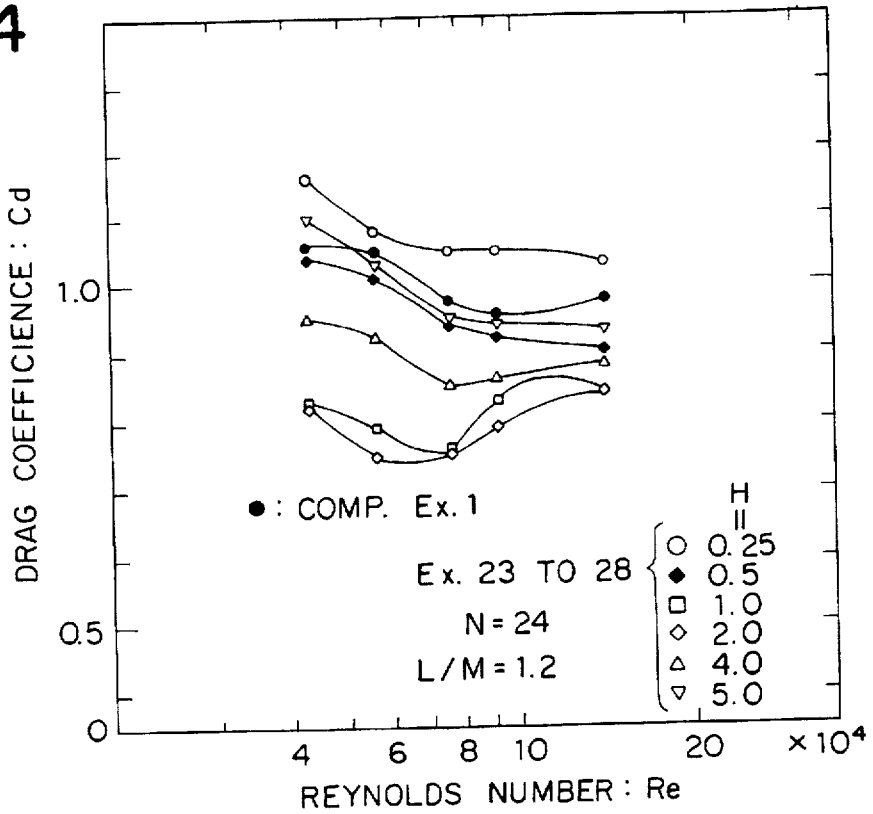
FIG. 14 is a view of the relationship between the drag coefficient and Reynold's number when setting a specific ratio L/M and number of grooves and changing the depth of the grooves.

Wind tunnel tests were conducted on overhead cables according to the first embodiment of the invention shown in FIG. 4 and cables according to the fifth embodiment shown in FIG. 17. Steel-reinforced aluminum cables of a diameter D of 36.6 mm were prepared, the L/M of the sector-shaped cross-section segment strands 1 of the outermost layer was set to 1.2 and the number N of grooves to 24, and the depth H of the grooves 3 was changed (Examples 23 to 28). FIG. 14 shows the relationship between the drag coefficient Cd and the Reynold's number Re in this case.

From FIG. 14, it is learned that under conditions of a Reynold's number Re of over $5\times10^4$, the overhead cables of Examples 23 to 28 have smaller drag coefficients Cd than Comparative Example 1 in the range of a depth H of the substantially arc-shaped cross-section grooves 3 of 0.5 to 5 mm.

EXAMPLES 29 TO 34

Figure 15:
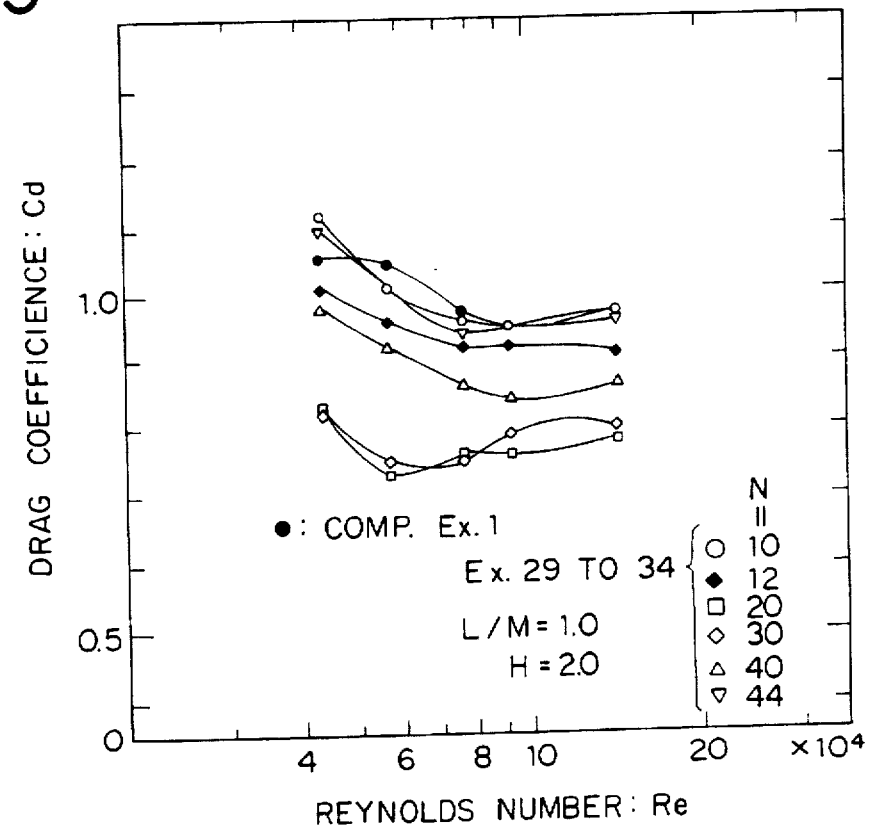
FIG. 15 is a view of the relationship between the drag coefficient and Reynold's number when setting a specific ratio L/M and depth of the grooves and changing the number of the grooves.

Wind tunnel tests were conducted on overhead cables according to the first embodiment of the invention shown in FIG. 4 and cables according to the fifth embodiment shown in FIG. 17. Steel-reinforced aluminum cables of a diameter D of 36.6 mm were prepared, the L/M of the sector-shaped cross-section segment strands 1 of the outermost layer was set to 1.2 and the depth H of the grooves 3 to 2.0, and the number N of grooves was changed (Examples 29 to 34). FIG. 15 shows the relationship between the drag coefficient Cd and the Reynold's number Re in this case.

From FIG. 15, it is learned that under conditions of a Reynold's number Re of over $5\times10^4$, the overhead cables of Examples 29 to 34 have smaller drag coefficients Cd than the conventional cable (Comparative Example 1).

EXAMPLES 35 AND COMPARATIVE EXAMPLES 2 AND 3

Wind tunnel tests were conducted on overhead cables according to the third embodiment of the invention shown in FIG. 6 and cables according to the seventh embodiment shown in FIG. 19 so as to measure the noise caused by wind. Use was made of cables equivalent to an ACSR of 610 $mm^2$ of the type shown in FIG. 6 or cables equivalent to an LP-XTACIR of 610 $mm^2$ of the type shown in FIG. 19. As the cable of Example 35, use was made of an overhead cable of an outer diameter D of 34.2 mm, a projecting height t of the outer surface projecting segment strand 11 (see FIG. 6) projecting from the outer surface of the other segment strands 1 of 3 mm, a deflector angle Θ of 45°, 18 grooves (number of segment strands at outermost layer), a depth H of the grooves 3 of 2.0 mm, and a twisting pitch of the twisted segment strands of 360 mm.

Figure 1:
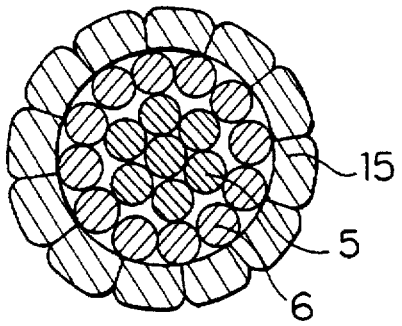
FIG. 1 PRIOR ART
FIG. 1 is a view of one example of a conventional overhead cable.
Figure 2:
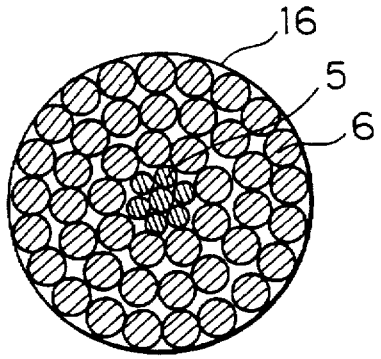
FIG. 2 PRIOR ART
FIG. 2 is a view of another example of a conventional overhead cable.
Figure 3:
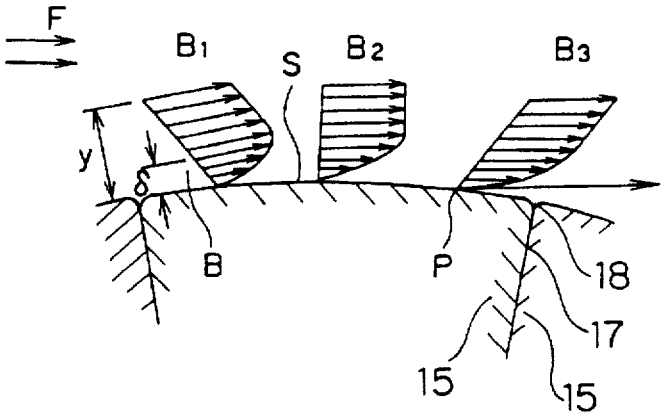
FIG. 3 PRIOR ART
FIG. 3 is a view explaining the state of a boundary layer at the surface of an overhead cable in a stream of wind.

For comparison, a conventional cable of ACSR of 610 $mm^2$ was prepared as Comparative Example 2 and the cable of the type shown in FIG. 1 was prepared as Comparative Example 3.

Figure 16:
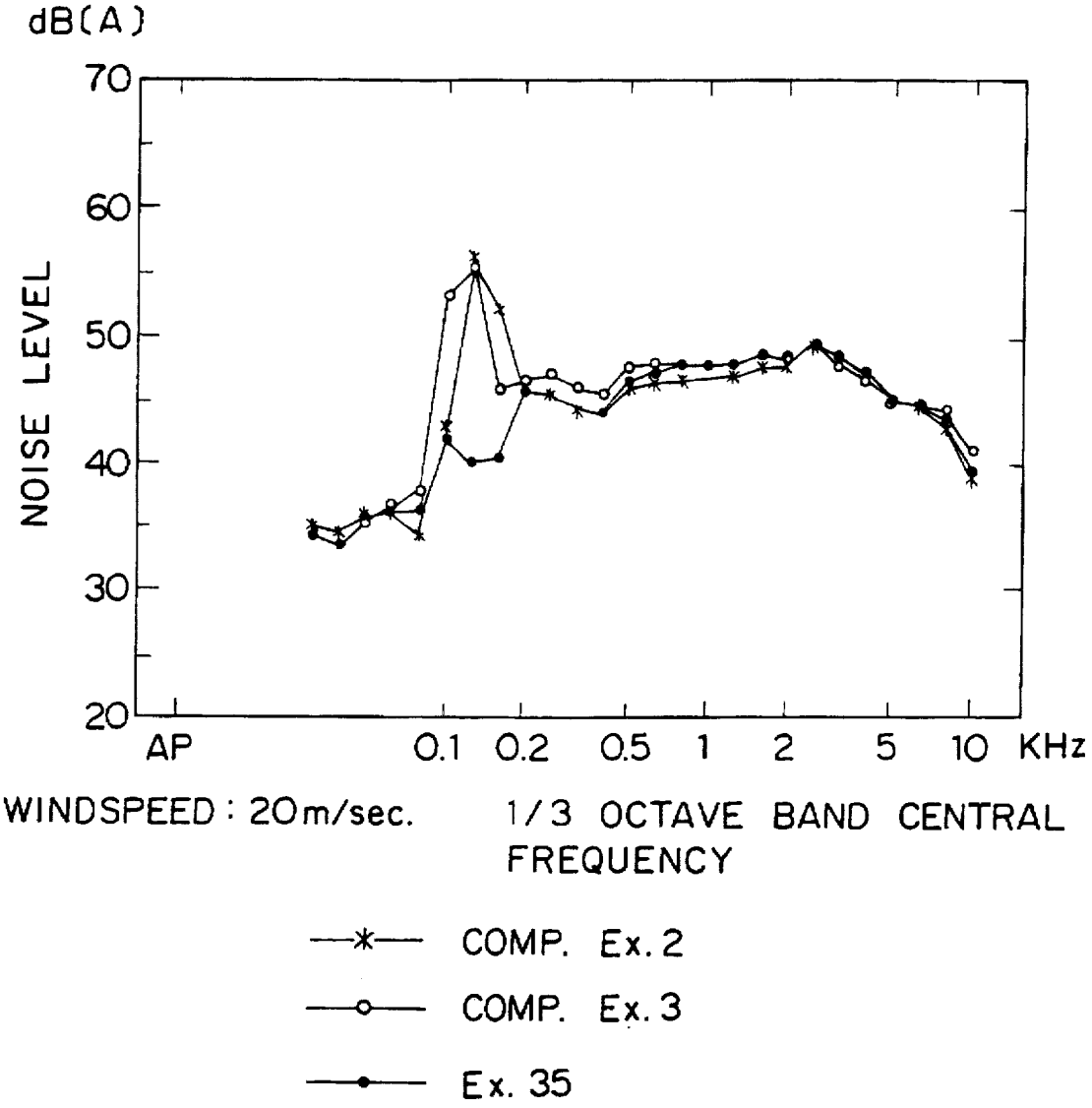
FIG. 16 is a view of the relationship between the noise level and frequency characteristics obtained from experiments comparing the noise caused by wind in the overhead cable of the present invention and conventional cables.

FIG. 16 shows the relationship between the noise level and frequency characteristics of the cables of Example 35 and Comparative Examples 2 and 3 at a windspeed of 20 m/s.

From the results of the tests, it was confirmed that the overhead cable according to Example 35 of the present invention is greatly reduced in noise level to as much as 15 to 22 dB (A) near 100 to 130 Hz.

EXAMPLE 36

Figure 21:
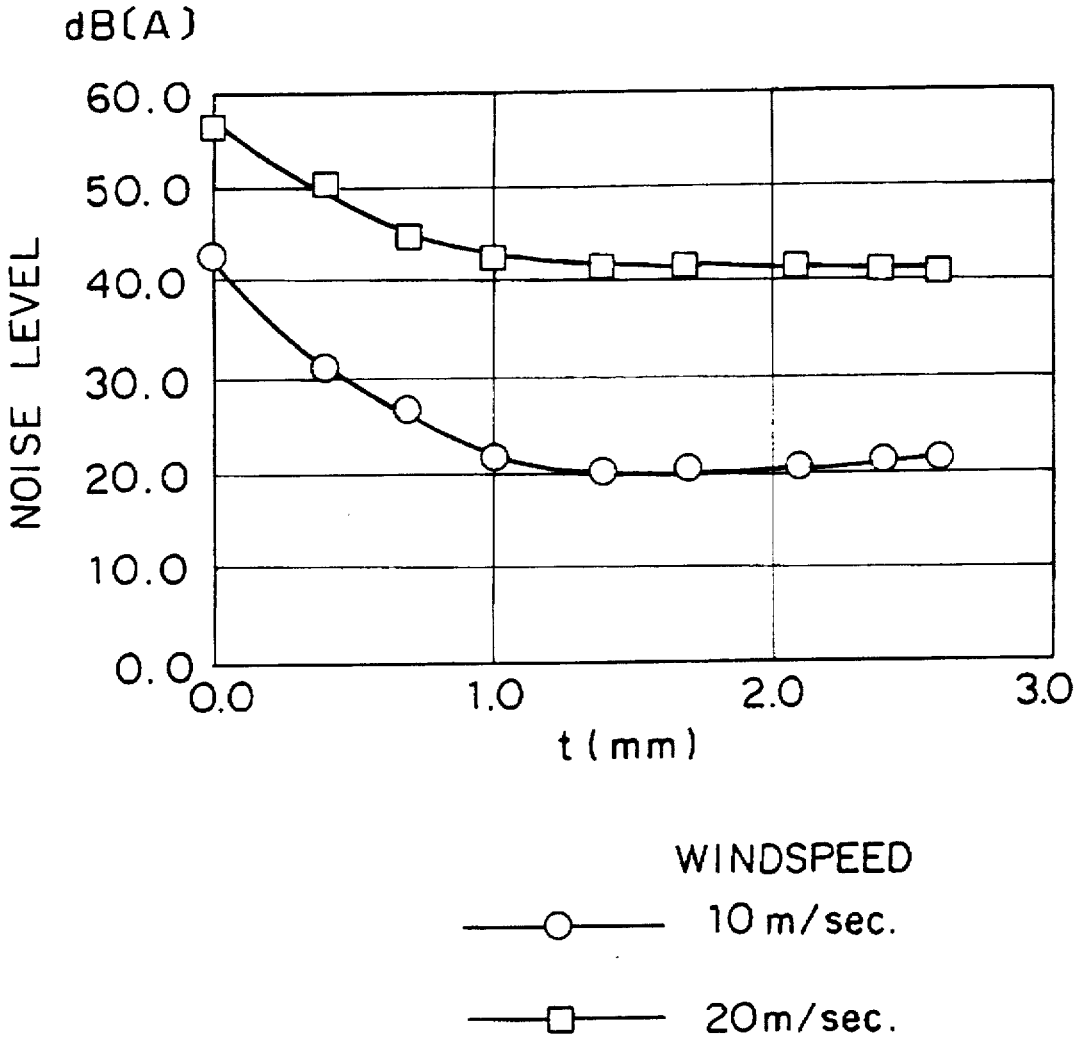
FIG. 21 is a graph of the relationship between the projecting height of a step difference and noise.
Figure 22A:
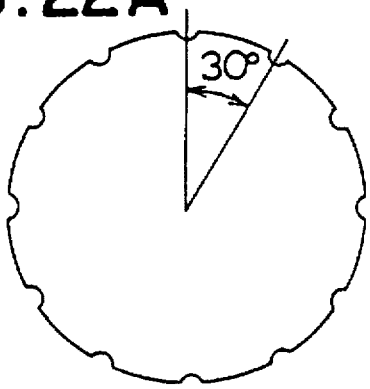
FIGS. 22A to 22F are cross-sectional views of other shapes of cables subjected to wind tunnel tests.
Figure 22B:
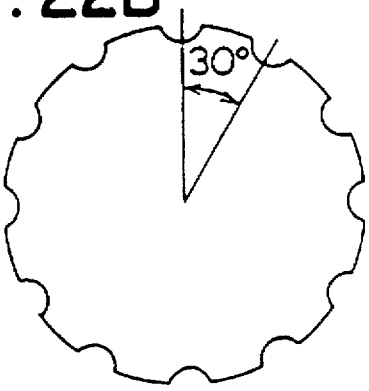
Figure 22C:
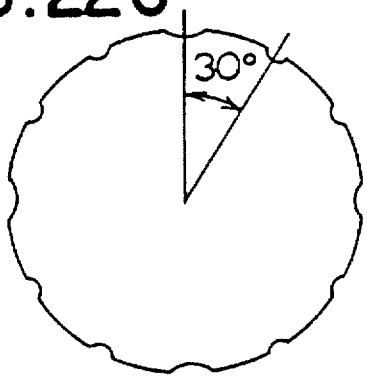
Figure 22D:
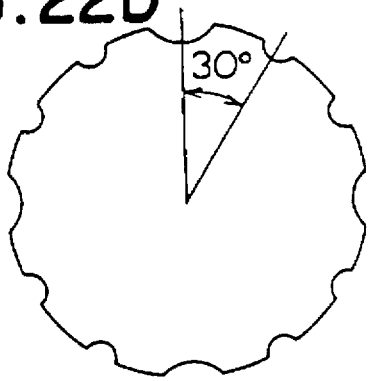
Figure 22E:
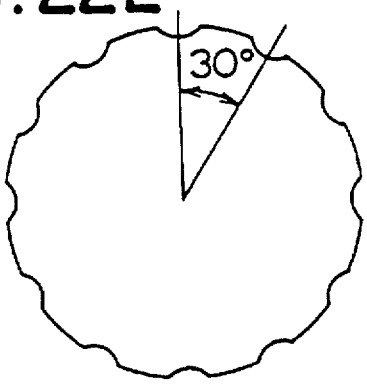
Figure 22F:
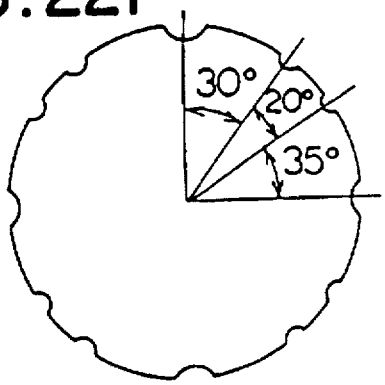
Figure 23G:
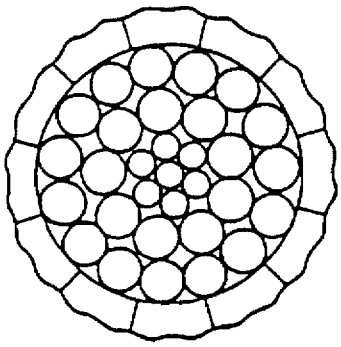
FIGS. 23G to 23J are cross-sectional views of other shapes of cables subjected to wind tunnel tests.
Figure 23H:
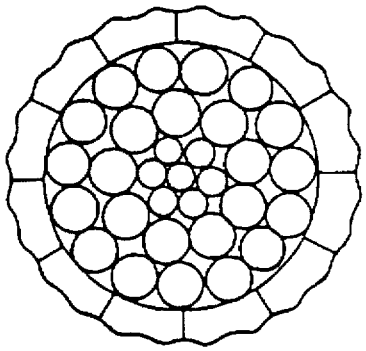
Figure 23I:
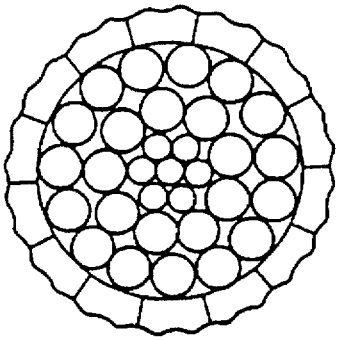
Figure 23J:
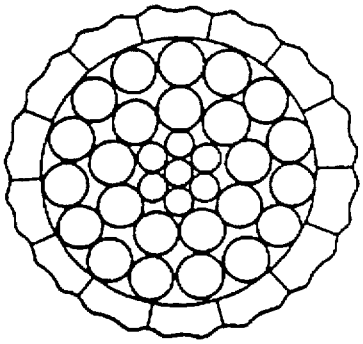

FIG. 21 shows the results of measurement of the noise level at outstanding frequencies when changing the step difference t from 0 to 2.7 mm in the wind noise characteristics (FIG. 16) of the cable with no step difference as shown in FIG. 4 and the cable having a step difference t as shown in FIG. 5 to FIG. 7. In FIG. 21, the noise level when t=0 mm is the noise level of a cable with no step difference of FIG. 4. It is learned that compared with the cable of FIG. 4, as the step difference becomes gradually higher, the effect of the step difference in preventing wind noise becomes saturated in the range of t>1.5 mm. It is considered that noise cannot be differentiated from surrounding noise in the case of a strong wind of 20 m/s, the wind speed which people sense as noise, there is a problem in the windspeeds lower than this. It is considered that there is no problem if the noise is 10 dB lower than the level of the noise caused by wind in the case of the cable with no step difference of FIG. 4. Accordingly, as a result of the measurements of FIG. 21, it is found that the effective range of the step difference t is 0.5 to 2.0 mm.

EXAMPLE 37

The contours of the cross-sections of the cables of FIGS. 22A to 22F and the contours of the cross-sections of the cables of FIGS. 23G to 23J are models of cross-sections of cable used in fluid analysis by computer. These models differ in the number of the arc-shaped grooves formed in the surface of the cables and the depth and widths of the grooves. It was found by simulation that these differences resulted in different sizes and numbers of the vortexes formed down the cross-sections of the cables and the breakaway points of the vortexes.

CONCLUSIONS

As explained above, the overhead cable of the present invention is provided with substantially arc-shaped cross-section grooves at the adjoining portions of the sector-shaped cross-section segment strands of the outermost layer. Therefore, the adjoining portions of the segment strands on the outer circumference of the overhead cable are not formed with the step difference of the conventional V-shaped grooves, but have grooves of a concave arc-shape. The breakaway point of the boundary layer where the wind flows along the surface can be made to shift to the downwind side of the overhead cable to reduce the wind load. Further, it is possible to fabricate a low wind load cable easily and at low cost.

Further, it is possible to obtain the effect of further reduction of the wind load by making the ratio L/M of the width L of the substantially arc-shaped cross-section grooves and a width M of the non-groove portions of the surface of the sector-shaped cross-section segment strands a range 0.10 to 1.55, by making the ratio H/D of a maximum depth H of the substantially arc-shaped cross-section grooves and a diameter D of the overhead cable a range of 0.0055 to 0.082, and making the number of the sector-shaped cross-section segment strands twisted at the outermost layer from 6 to 36.

Further, the overhead cable of the present invention is provided with outer surface projecting segment strands with outer surfaces which project out among the sector-shaped cross-section segment strands twisted at the outermost layer, so not only can the wind load be reduced, but also the wind noise can be reduced and the corona noise at the time of light rain can be reduced. Further, by making the height of the outer surface projecting segment strands in the range of 0.5 to 5 mm, the noise can be made smaller and, further, by providing a deflector angle Θ of 15° to 60° at the two shoulders of the outer surface projecting segment strands, it is possible to increase the effect of reduction of the wind load.

Since the height of the step difference of the outer surface projecting segment strands projecting from the outer surfaces of the sector-shaped cross-section segment strands at the outermost layer is made much lower than the projecting height of conventional low noise cables, the lift force caused when being struck by wind from substantially vertical direction of the cable becomes much lower and low frequency and large amplitude galloping vibration becomes difficult to occur.

Further, since the low sag, low wind load cables of the present invention use invar strands for the cores and segment strands of super-high heat resisting aluminum alloy or extra-high heat resisting aluminum alloy for the outermost layer, it is possible to greatly suppress the sag at high temperatures. Accordingly, the amount of sideways swinging of the overhead cables when receiving a strong wind in the lateral direction can also be greatly suppressed along with the low wind load structure. As a result, it is possible to remarkably reduce the height of steel towers, the arm widths, the foundations, etc. and greatly cut the constructing transmission systems. This is an effect not seen in conventional invar strands or low wind load cables and will enable easy realization of more compact steel towers in the future for large bundle multiconductor transmission lines, 1000 kV-UHV transmission lines, etc.

Further, if the low sag, low wind load cable of the present invention is applied to a 500 kV class ACSR 810 $mm^2$ four-conductor, two-line transmission line, the design wind load can be reduced to 600 MPa in the present invention as compared with the 1000 MPa of the prior art, the current capability can be doubled, and the increase in the sag can be suppressed, so it is possible to reduce the weight of a steel tower by 7 percent and the overall construction costs by about 5 percent.

While the invention has been described by reference to specific embodiments chosen for purposes of illustration, it should be apparent that numerous modifications could be made thereto by those skilled in the art without departing from the basic concept and scope of the invention.

We claim:

1. An overhead cable comprising:

a core as a first layer;

a second layer of strands twisted around the core; and a plurality of segment strands each having a sector-shape in cross-section, said plurality of segment strands twisted around said second layer to form an outermost layer and grooves having a substantially arc-shaped in cross-section formed at surfaces of each adjoining portion of the segment strands, said segment strands each having a non-groove portion between said adjoining portions.

2. The overhead cable as set forth in claim 1, wherein a ratio L/M of a circumferential width L of the substantially arc-shaped grooves and a circumferential width M of the non-groove portions of the sector-shaped segment strands is from 0.10 to 1.55.

3. The overhead cable as set forth in claim 1, wherein a ratio H/D of a maximum radial depth H of the substantially arc-shaped grooves and a diameter D of the overhead cable is from 0.0055 to 0.082.

4. The overhead cable as set forth in claim 1, wherein there are at least six and not more than 36 sector-shaped segment strands twisted at the outermost layer.

5. The overhead cable as set forth in claim 1, wherein at least one segment strand of the plurality of sector-shaped cross-section segment strand twisted at the outer most layer is comprised of an outer surface projecting segment strand projecting from 0.5 to 5 mm from the outer surface of other segment strands.

6. The overhead cable as set forth in claim 5, wherein a deflector angle θ of from 15° to 60° is provided at shoulders of said outer surface projecting segment strands formed with projecting step differences.

7. The overhead cable as set forth in claim 5, wherein there are at least two of said outer surface projecting segment strands twisted around the outermost layer and the step difference t of the outer surface projecting segment strands and the center angle Θ2 of said group of outer surface projecting segment strands are $0.5 \leqq t \leqq 2.0$ (mm) and $20° \leqq \Theta 2 \leqq 60°$.

8. The overhead cable as set forth in claim 1, wherein the grooves provided at the adjoining portions of the sector-shaped segment strands at the outermost layer are grooves of a substantially, semicircular cross-section and at least one substantially semicircular cross-section groove among the grooves of the outermost layer has a substantially circular cross-section strand fitted in one of the at lest one substantially semicircular cross-section groove.

9. A low sag, low wind load cable comprising:

tension bearing cores comprised of strands of a linear expansion coefficient of from $-6\times10^{-6}$ to $6\times10^{-6}$/°C. and an elastic modulus of from 100 to 600 GPA and a plurality of segment strands each having a sector shape in cross section, said plurality of segment strands twisted around the tension-bearing cores to form an outer most circumference of the cable and comprised of a heat resisting aluminum alloy, and grooves having a substantially arc-shape in cross-section formed at surfaces of each adjoining portion of said twisted segment strands, said segment strands each having a non-groove portion between said joining portions.

10. The low sag, low wind load cable as set forth in claim 9, wherein the tension-bearing cores are comprised of high elastic modulus strands having a linear expansion coefficient of from $-6\times10^{-6}$ to $6\times10^{-6}$/°C. and an elastic modulus of from 100 to 600 GPA.

11. The low sag, low wind load cable as set forth in claim 9, wherein a ratio L/M of a circumferential width L of the substantially arc-shaped grooves and a circumferential width M of the non-groove portions of the sector-shaped cross-section segment strands is from 0.10 to 1.55.

12. The low sag, low wind load cable as set forth in claim 9, wherein a ratio H/D of a maximum radial depth H of the substantially arc-shaped grooves and a diameter D of the cable is from 0.0055 to 0.082.

13. The low sag, low wind load cable as set forth in claim 9, wherein at least one segment strand of the plurality of sector-shaped cross-section segment strands twisted at the outermost layer is comprised of an outer surface projecting segment strand projecting from 0.5 to 5.0 mm from the outer surface of other segment strands.

14. The low sag, low wind load cable as set forth in claim 13, wherein two outer surface projecting segment strand projects from 0.5 to 2.0 mm from the outer surface of the other segment strands.

15. The low sag, low wind load cable as set forth in claim 13, wherein the outer surface projecting segment strand projects from 0.5 to 2.0 mm from the outer surface of the other segment strands.

16. The low sag, low wind load cable as set forth in claim 13, wherein a deflector angle θ of from 15° to 60° Is provided at shoulders of said outer surface projecting segment strands formed with projecting step differences are $0.5 \leqq t \leqq 2.0$ (mm) and $20° \leqq \Theta_2 \leqq 60°$.

17. The low sag, low wind load cable as set forth in claim 13, wherein there are at least two of said outer surface projecting segment strands twisted at the outermost layer and the step difference "t" of the outer surface projecting segment strands and the center angle Θ2 of said outer surface projecting segment strands are $0.5 \leqq t \leqq 2.0$ (mm) and $20° \leqq \Theta 2 \leqq 60°$.

18. The low sag, low wind load cable as set forth in claim 9, wherein the grooves provided at the adjoining portions of the sector-shaped cross-section segment strands forming the outermost layer are grooves of a substantially semicircular cross-section, at least one substantially semicircular cross-section groove among the grooves of the outermost layer has a substantially circular cross-section strand fitted in one of the at least one substantially semicircular cross-section groove, and a step difference is formed so that the outermost surface of the circular cross-section strand is made to project radially outward from the outer surface of the sector-shaped cross-section segment strands.

19. The low sag, low wind load cable as set forth in claim 9, wherein the number N of the sector-shaped segment strands forming the outermost circumference layer is from 6 to 36.

20. The low sag, low wind load cable as set forth in claim 9, wherein the tension-bearing cores comprise composite strands made of filaments of a material selected from the group consisting of silicon carbide, carbon, alumina, and aromatic polyamide and having on an outer surface thereof a metal covering selected from group consisting of aluminum, zinc, chrome, and copper.

* * * * *